US009035735B2

(12) United States Patent
Yano et al.

(10) Patent No.: US 9,035,735 B2
(45) Date of Patent: May 19, 2015

(54) COIL TERMINAL

(75) Inventors: Keisuke Yano, Kikuchi (JP); Ryuichi Hashimoto, Yamaga (JP); Yasuo Hayashida, Kumamoto (JP); Shingo Mori, Yamaga (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 13/583,210

(22) PCT Filed: Mar. 14, 2011

(86) PCT No.: PCT/JP2011/055933

§ 371 (c)(1),
(2), (4) Date: Nov. 15, 2012

(87) PCT Pub. No.: WO2011/115054

PCT Pub. Date: Sep. 22, 2011

(65) Prior Publication Data

US 2013/0057377 A1 Mar. 7, 2013

(30) Foreign Application Priority Data

Mar. 15, 2010 (JP) ..... 2010-058009
Mar. 15, 2010 (JP) ..... 2010-058010

(51) Int. Cl.
*H01F 27/29* (2006.01)
*H01F 27/30* (2006.01)
(Continued)

(52) U.S. Cl.
CPC . *H01H 1/36* (2013.01); *H01H 1/66* (2013.01); *H01H 50/40* (2013.01); *H01H 50/60* (2013.01);
(Continued)

(58) Field of Classification Search
CPC ..... H01F 5/04; H01F 27/06
USPC ..... 336/65, 105, 192, 198
See application file for complete search history.

(56) References Cited

U.S. PATENT DOCUMENTS 2,414,961 A 1/1947 Mason et al.
3,444,490 A 5/1969 Bowles et al.
(Continued)

FOREIGN PATENT DOCUMENTS

CN 1519874 8/2004
CN 1701403 11/2005
(Continued)

OTHER PUBLICATIONS

Non-Final Office Action mailed Mar. 26, 2014, U.S. Appl. No. 13/583,211, 9 pages.
(Continued)

*Primary Examiner* — Alexander Talpalatski
*Assistant Examiner* — Joselito Baisa
(74) *Attorney, Agent, or Firm* — Klarquist Sparkman, LLP

(57) ABSTRACT

An object of the present invention is to provide a contact coil terminal having smaller numbers of components and assembling manhours, and thus, higher productivity. For this, there is a coil terminal 153 in which a press-fitting portion is pressed into a press-fitting groove (152*c*) provided at a corner portion of a flange portion (152*a*) of a spool (152) with a coil wound therearound, and a lead-out line of the coil is entwined around a coil entwining portion (153*a*) projected from the flange portion (152*a*), and the coil entwining portion (153*a*) is bent and raised. Particularly, the coil entwining portion (153*a*) extends in an opposite direction of a press-fitting direction of the press-fitting portion so as to be able to be bent and raised, and a lead wire connecting portion (153*b*) extends laterally to the press-fitting direction so as to be able to be bent and raised.

11 Claims, 39 Drawing Sheets

(51) Int. Cl.

| | |
|---|---|
| ***H01F 17/00*** | (2006.01) |
| ***H01H 1/36*** | (2006.01) |
| ***H01H 1/66*** | (2006.01) |
| ***H01H 50/40*** | (2006.01) |
| ***H01H 50/60*** | (2006.01) |
| ***H01H 51/06*** | (2006.01) |
| ***H01H 51/00*** | (2006.01) |
| ***H01H 50/30*** | (2006.01) |
| ***H01H 50/54*** | (2006.01) |
| ***H01H 50/04*** | (2006.01) |
| ***H01H 50/00*** | (2006.01) |
| ***H01H 50/02*** | (2006.01) |
| ***H01H 9/44*** | (2006.01) |
| ***H01H 50/44*** | (2006.01) |

(52) U.S. Cl.

CPC ..... *H01H 51/06* (2013.01); *H01H 51/00* (2013.01); *H01H 50/30* (2013.01); *H01H 50/54* (2013.01); *H01H 50/045* (2013.01); *H01H 50/00* (2013.01); *H01H 50/02* (2013.01); *H01H 9/443* (2013.01); *H01H 50/443* (2013.01); *H01H 2050/025* (2013.01)

(56) References Cited

U.S. PATENT DOCUMENTS

| | | | | |
|---|---|---|---|---|
| 3,701,961 | A * | 10/1972 | Folk | 336/192 |
| 3,848,208 | A * | 11/1974 | Dawson et al. | 336/96 |
| 4,028,654 | A * | 6/1977 | Bullard et al. | 336/92 |
| 4,347,493 | A * | 8/1982 | Adams et al. | 336/192 |
| 4,404,533 | A | 9/1983 | Kurihara et al. | |
| 4,423,399 | A * | 12/1983 | Goodrich | 335/202 |
| 4,581,820 | A * | 4/1986 | Zahn et al. | 29/855 |
| 4,755,781 | A | 7/1988 | Bogner | |
| 4,825,180 | A | 4/1989 | Miyaji | |
| 4,945,328 | A * | 7/1990 | Kinney et al. | 335/202 |
| 5,103,107 | A | 4/1992 | Yamamoto et al. | |
| 5,394,128 | A | 2/1995 | Perreira et al. | |
| 5,426,410 | A | 6/1995 | Niimi | |
| 5,428,330 | A | 6/1995 | Tamemoto | |
| 5,524,334 | A * | 6/1996 | Boesel | 29/605 |
| 5,545,061 | A | 8/1996 | Sawayanagi | |
| 5,546,061 | A | 8/1996 | Okabayashi et al. | |
| 5,680,084 | A | 10/1997 | Kishi et al. | |
| 5,892,194 | A | 4/1999 | Uotome et al. | |
| 5,909,067 | A | 6/1999 | Liadakis | |
| 5,990,771 | A | 11/1999 | Quentric | |
| 6,060,468 | A * | 5/2000 | Jørgensen et al. | 514/218 |
| 6,181,230 | B1 * | 1/2001 | Broome et al. | 336/198 |
| 6,400,132 | B1 * | 6/2002 | Koumura | 324/146 |
| 6,768,405 | B2 | 7/2004 | Nishida et al. | |
| 6,911,884 | B2 | 6/2005 | Uotome et al. | |
| 7,023,306 | B2 | 4/2006 | Nishida et al. | |
| 7,157,995 | B2 | 1/2007 | Nishida et al. | |
| 7,286,031 | B2 | 10/2007 | Nishida et al. | |
| 7,852,178 | B2 | 12/2010 | Bush et al. | |
| 7,859,373 | B2 | 12/2010 | Yamamoto et al. | |
| 7,868,720 | B2 | 1/2011 | Bush et al. | |
| 7,911,301 | B2 | 3/2011 | Yano et al. | |
| 7,948,338 | B2 | 5/2011 | Niimi et al. | |
| 7,978,035 | B2 | 7/2011 | Usami et al. | |
| 8,138,863 | B2 | 3/2012 | Tanaka et al. | |
| 8,138,872 | B2 | 3/2012 | Yoshihara et al. | |
| 8,179,217 | B2 | 5/2012 | Kawaguchi et al. | |
| 8,188,818 | B2 | 5/2012 | Cho et al. | |
| 8,198,964 | B2 | 6/2012 | Yoshihara et al. | |
| 8,222,980 | B2 | 7/2012 | Yamagata et al. | |
| 8,232,499 | B2 | 7/2012 | Bush et al. | |
| 8,237,524 | B2 | 8/2012 | Niimi et al. | |
| 8,248,195 | B2 | 8/2012 | Ryuen et al. | |
| 8,350,645 | B2 | 1/2013 | Yeon | |
| 8,390,408 | B2 | 3/2013 | Nawa | |
| 8,390,410 | B2 | 3/2013 | Kojima et al. | |
| 8,410,878 | B1 | 4/2013 | Takaya et al. | |
| 2004/0027776 | A1 | 2/2004 | Uotome et al. | |
| 2004/0066261 | A1 | 4/2004 | Nishida et al. | |
| 2004/0080389 | A1 | 4/2004 | Nishida et al. | |
| 2005/0146405 | A1 | 7/2005 | Nishida et al. | |
| 2005/0151606 | A1 | 7/2005 | Nishida et al. | |
| 2006/0050466 | A1 | 3/2006 | Enomoto et al. | |
| 2006/0109070 | A1 | 5/2006 | Hirabayashi et al. | |
| 2007/0241847 | A1 | 10/2007 | Yamamoto et al. | |
| 2008/0007373 | A1 | 1/2008 | Andoh et al. | |
| 2008/0122562 | A1 | 5/2008 | Bush et al. | |
| 2008/0157359 | A1 | 7/2008 | Yokobayashi et al. | |
| 2009/0066450 | A1 | 3/2009 | Yano et al. | |
| 2009/0322453 | A1 | 12/2009 | Kawaguchi et al. | |
| 2009/0322454 | A1 | 12/2009 | Tanaka et al. | |
| 2009/0322455 | A1 | 12/2009 | Yoshihara et al. | |
| 2010/0060392 | A1 | 3/2010 | Cho et al. | |
| 2010/0289604 | A1 | 11/2010 | Kojima et al. | |
| 2011/0032059 | A1 | 2/2011 | Ito et al. | |
| 2011/0156845 | A1 | 6/2011 | Eum | |
| 2013/0057369 | A1 | 3/2013 | Yano et al. | |
| 2013/0063232 | A1 | 3/2013 | Takaya et al. | |
| 2013/0127571 | A1 | 5/2013 | Takaya et al. | |
| 2013/0229248 | A1 | 9/2013 | Yokoyama et al. | |
| 2013/0234811 | A1 | 9/2013 | Nishimura | |
| 2013/0257567 | A1 | 10/2013 | Takaya et al. | |

FOREIGN PATENT DOCUMENTS

| | | |
|---|---|---|
| CN | 101211885 | 7/2008 |
| CN | 101620951 | 1/2010 |
| CN | 101630567 | 1/2010 |
| CN | 101667511 | 3/2010 |
| DE | 10 2004 0139 | 10/2005 |
| EP | 0 798 752 | 10/1997 |
| EP | 1 164 613 | 12/2001 |
| EP | 1 353 348 | 10/2003 |
| EP | 1 548 782 | 6/2005 |
| EP | 1 768 152 | 3/2007 |
| EP | 1 953 784 | 8/2008 |
| EP | 2 141 714 | 1/2010 |
| EP | 2 141 723 | 1/2010 |
| EP | 2 141 724 | 1/2010 |
| GB | 594623 | 11/1947 |
| JP | S60 51862 | 4/1985 |
| JP | 05-012974 | 1/1993 |
| JP | H07-042964 | 8/1995 |
| JP | H08-022760 | 1/1996 |
| JP | H09-259728 | 10/1997 |
| JP | 10-326530 | 12/1998 |
| JP | H11-154445 | 6/1999 |
| JP | 2004-71510 A | 3/2004 |
| JP | 2004-71512 | 3/2004 |
| JP | 2004-256349 | 9/2004 |
| JP | 2005071915 | 3/2005 |
| JP | 2005-139276 | 6/2005 |
| JP | 2005-203306 | 7/2005 |
| JP | 3690009 | 8/2005 |
| JP | 2006-19148 | 1/2006 |
| JP | 2006-310249 | 11/2006 |
| JP | 2008289613 | 12/2006 |
| JP | 2007-294264 | 11/2007 |
| JP | 2007-330012 | 12/2007 |
| JP | 2009-199894 | 9/2009 |
| JP | 2009-211831 | 9/2009 |
| JP | 2009-230920 | 10/2009 |
| JP | 4466421 | 5/2010 |

OTHER PUBLICATIONS

Omron Corporation, Extended European Search Report dated Jul. 16, 2014, EP Appln No. 11756235.5, 9 pages.

Omron Corporation, Chinese Office Action dated Jun. 30, 2014, CN Appln. No. 201180014092.3 (with translation), 11 pages.

Omron Corporation, Extended European Search Report dated Jul. 7, 2014, EP Appln No. 11756242.1, 6 pages.

Omron Corporation, Extended European Search Report dated Jul. 11, 2014, EP Appln No. 11756234.8, 6 pages.

(56) References Cited

OTHER PUBLICATIONS

Omron Corporation, Extended European Search Report dated Jul. 16, 2014, EP Appln. No. 11756240.5, 6 pages.
Omron Corporation, Extended European Search Report dated Jul. 16, 2014, EP Appln. No. 11756239.7, 6 pages.
Omron Corporation, Chinese Office Action dated Aug. 13, 2014, CN Appln. No. 201180014059.0 (with translation), 15 pages.
Omron Corporation, Extended European Search Report dated Jul. 11, 2014, EP Appln. No. 11756238.9, 7 pages.
Omron Corporation, Chinese Office Action dated Aug. 1, 2014, CN Appln. No. 201180014178.6 (with translation), 9 pages.
Omron Corporation, Extended European Search Report dated Jul. 9, 2014, EP Appln. No. 11756237.1, 6 pages.
Omron Corporation, Chinese Office Action dated Jul. 16, 2014, CN Appln. No. 201180014056.7 (with translation), 20 pages.

* cited by examiner

Fig. 1 ( A )
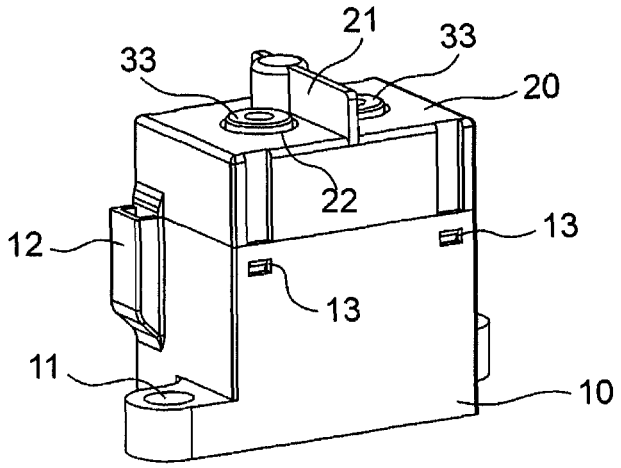
Fig. 1 ( B )
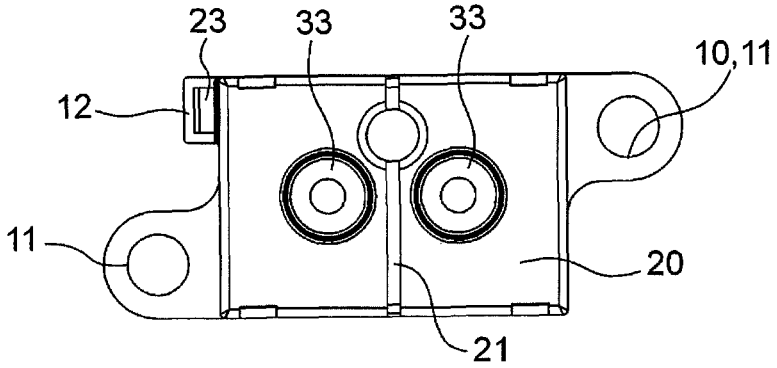
Fig. 1 ( C )
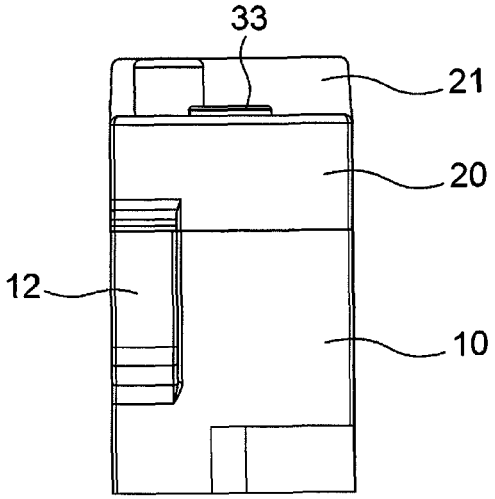

Fig. 3 ( A )
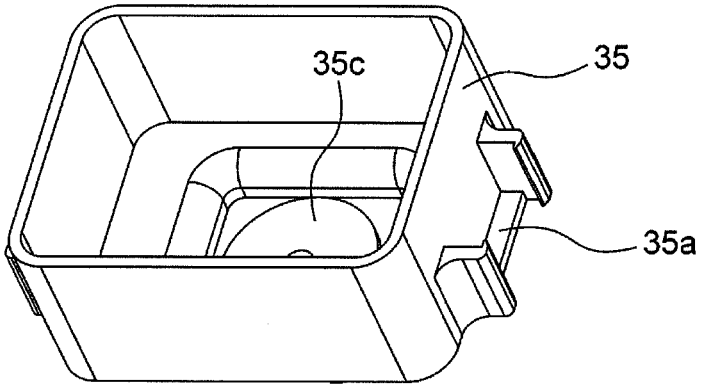
Fig. 3 ( B )
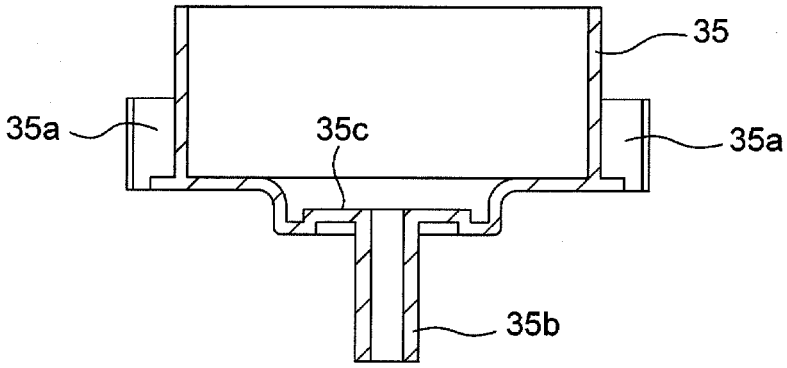
Fig. 3( C )
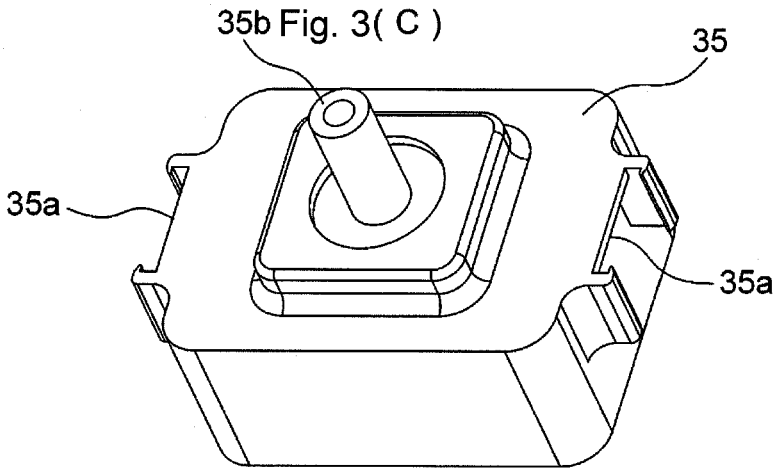

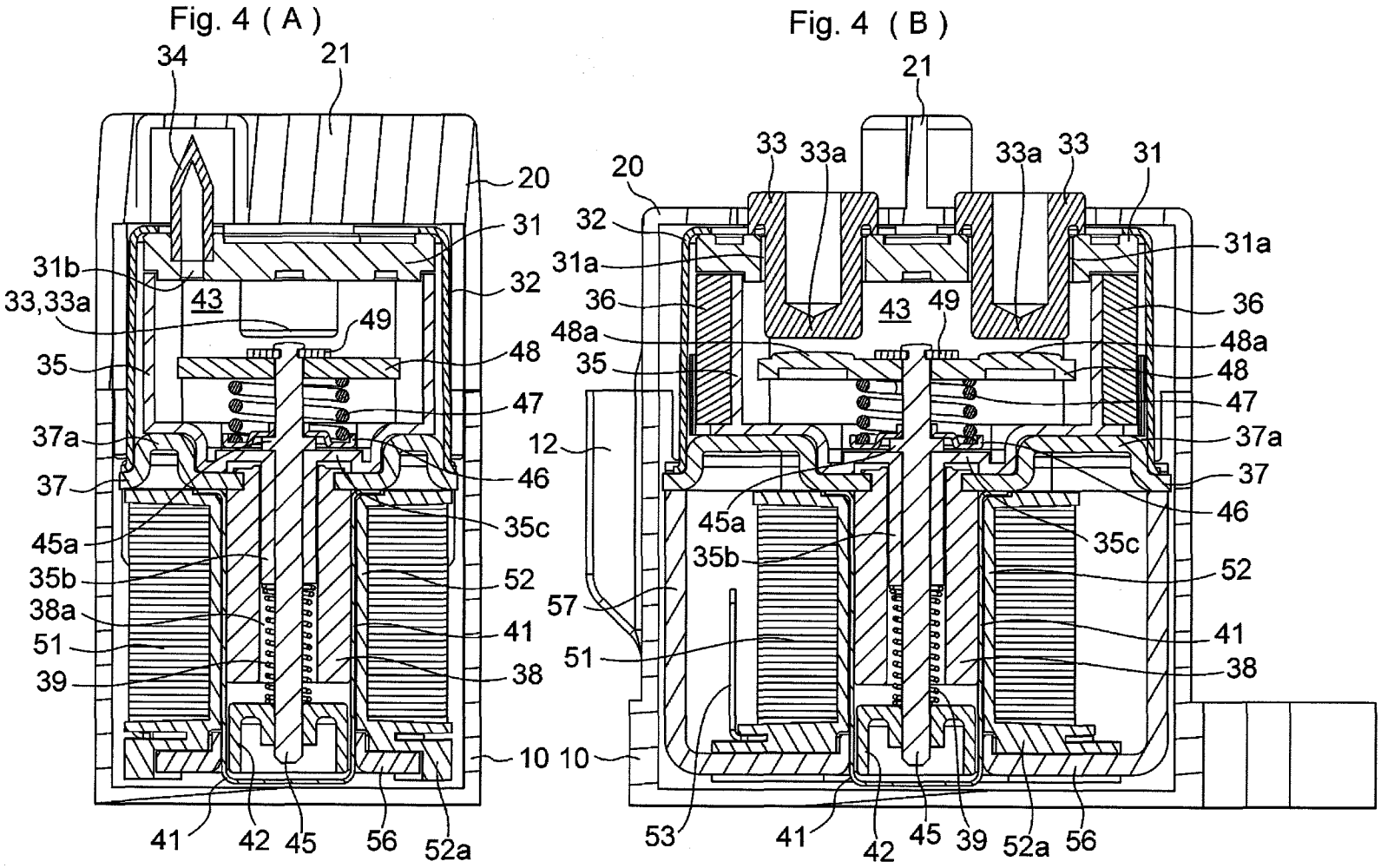
Fig. 4 ( B )
Fig. 4 ( A )
21
31
31a
33
33a
36
48a
48
47
37a
37
46
52
41
38
35c
56
52a
39
45
42
49
43
45a
35b
53
20
32
35
12
57
51
10
34
31b
33,33a
38a

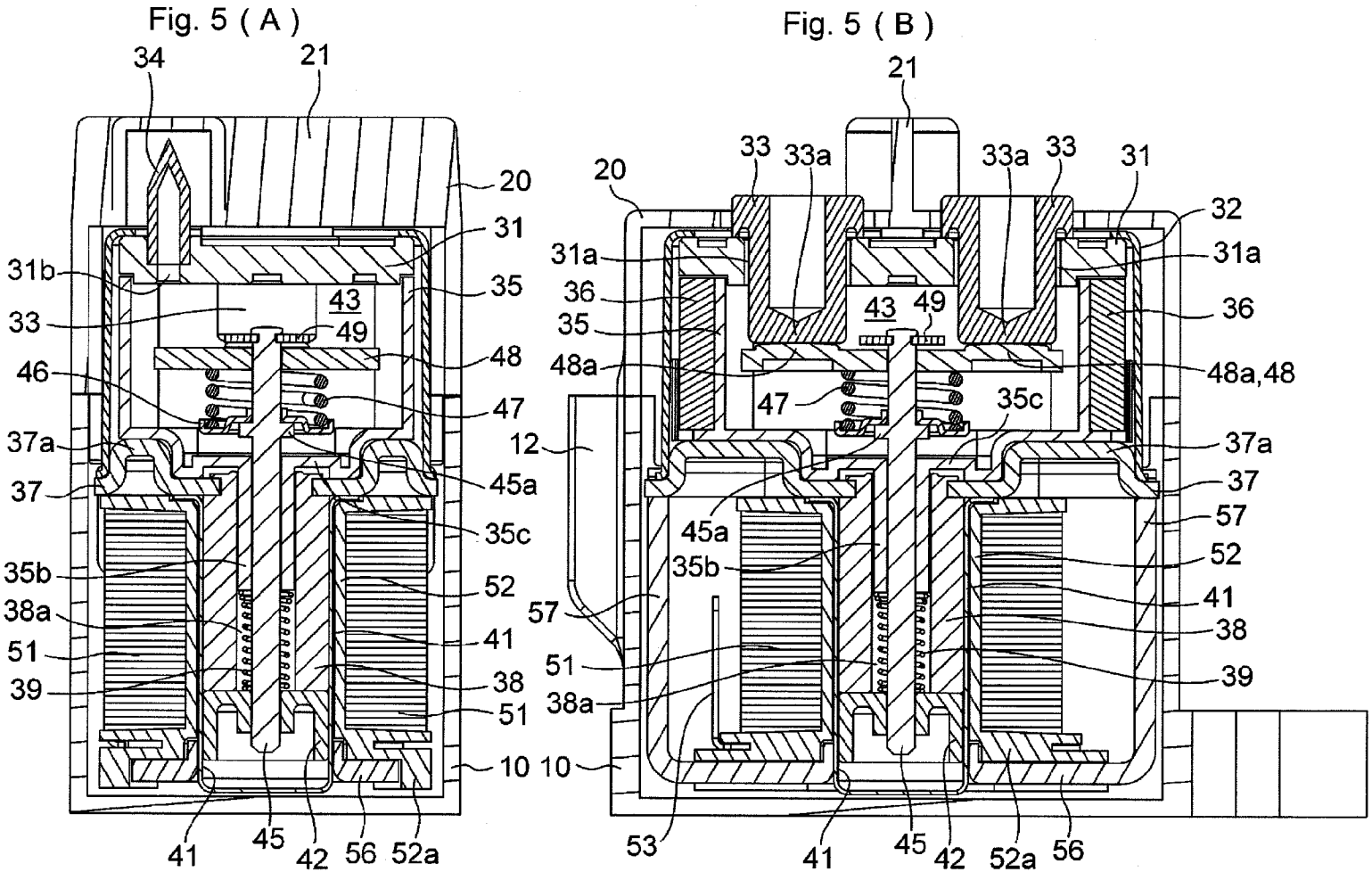
Fig. 5 ( B )
Fig. 5 ( A )
21
33
33a
31
32
31a
36
48a,48
37a
37
57
52
41
38
39
56
52a
42
45
35c
49
43
47
45a
35b
53
20
35
48a
12
51
38a
10
34
31b
46
48

120
134
133a
131
120
143
160
160b
131b
161
161a
149
148
147b
146
137
135f
151
152
141
152a
110
156
158
145
142
141
132a
161a
162
147a
132
135
145a
135b
138
138a
139

121
149
133a
133
122
160
160b
132a
136
148a
132
112
163
135b
157
138a
139
152a
147a
135c
143
147b
161
133a
133
122
160
120
131
136
148a
148
135
163
137
135c
151
152
141
138
139
110
156
152a
158
145
142
141

120
134
133a
131
120
143
160
160b
131b
161
161a
149
148
147b
146
137
135f
151
152
141
138
152a
110
156
158
145
142
141
132a
161a
162
147a
132
135
145a
135b
138a
139

121
149
133a
133
122
161
133a
133
122
160
120
131
136
148a
148
132
135
163
145a
137
151
157
152
141
138
139
143
147b
147a
146
110
156
152a
158
145
142
141
136
148a
132
112
163
135c
135b
157
138a
139
152a

Fig. 26 (A)
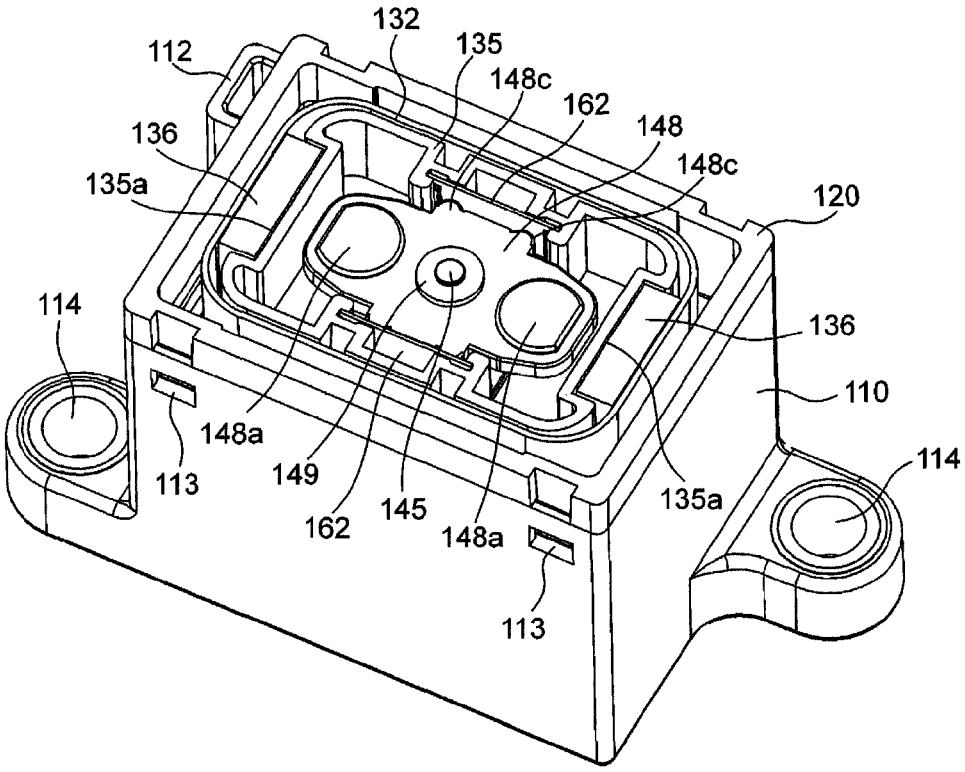
Fig. 26( B )
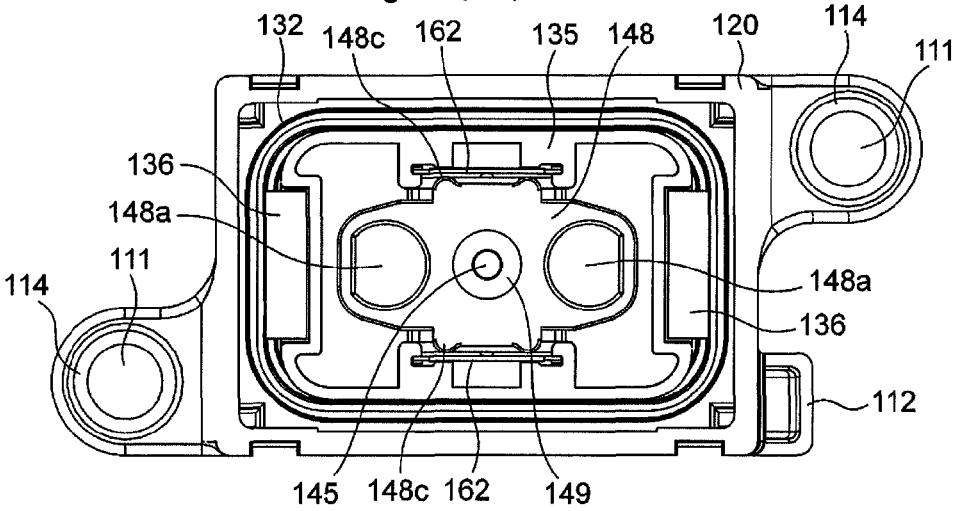

Fig. 28( A )
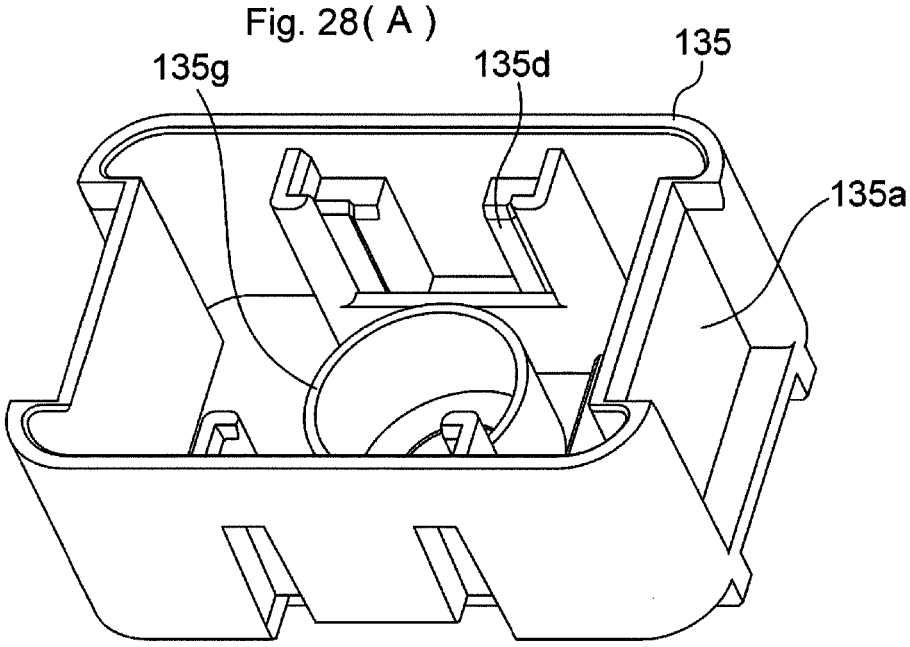
Fig. 28( B )
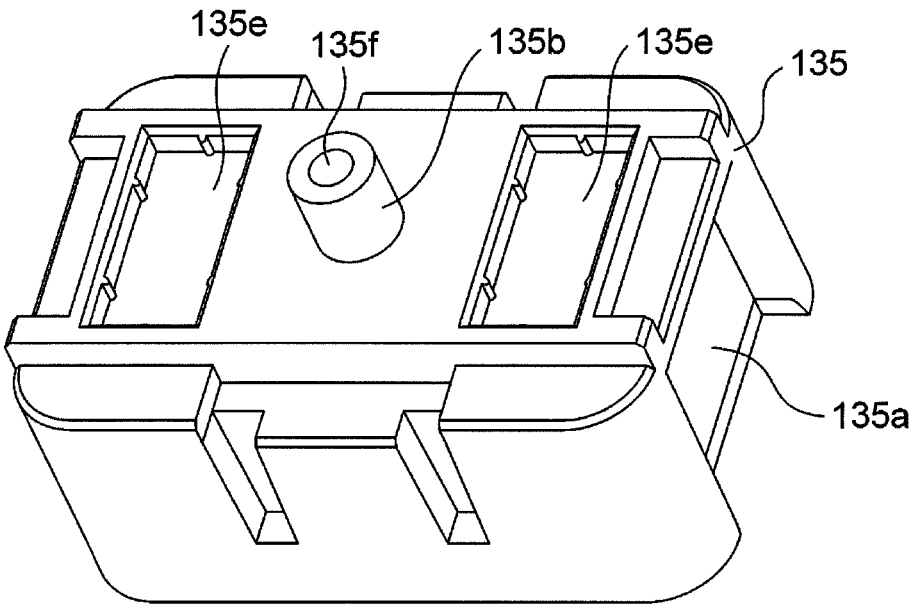

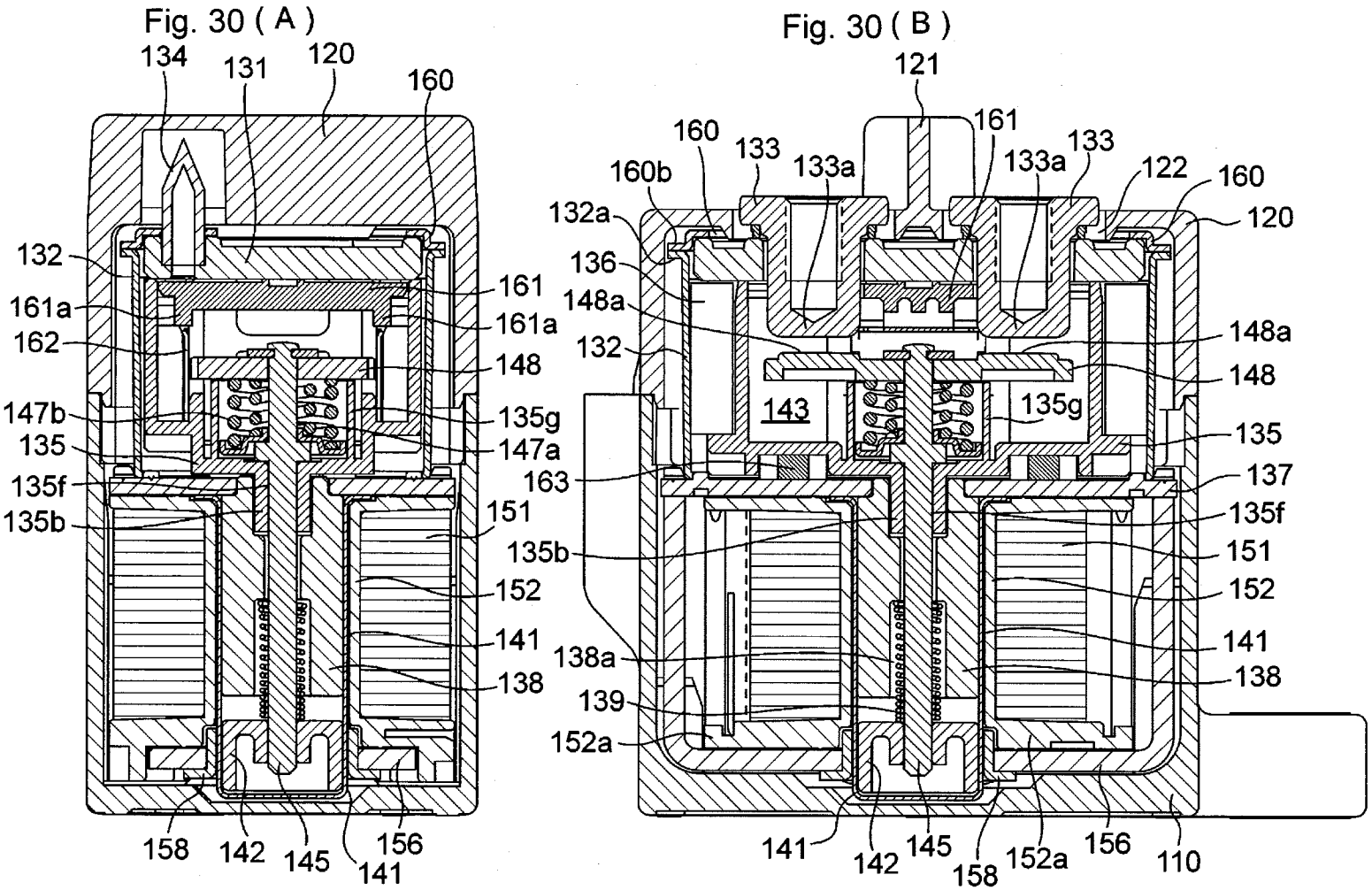
Fig. 30 ( B )
120
160
122
133
133a
161
121
133a
133
160
160b
132a
136
148a
148
135
137
135f
151
152
141
138
110
156
152a
158
145
142
141
135g
143
132
163
135b
138a
139
152a
Fig. 30 ( A )
160
120
131
134
161
161a
148
135g
147a
151
152
141
138
156
141
145
142
158
132
161a
162
147b
135
135f
135b

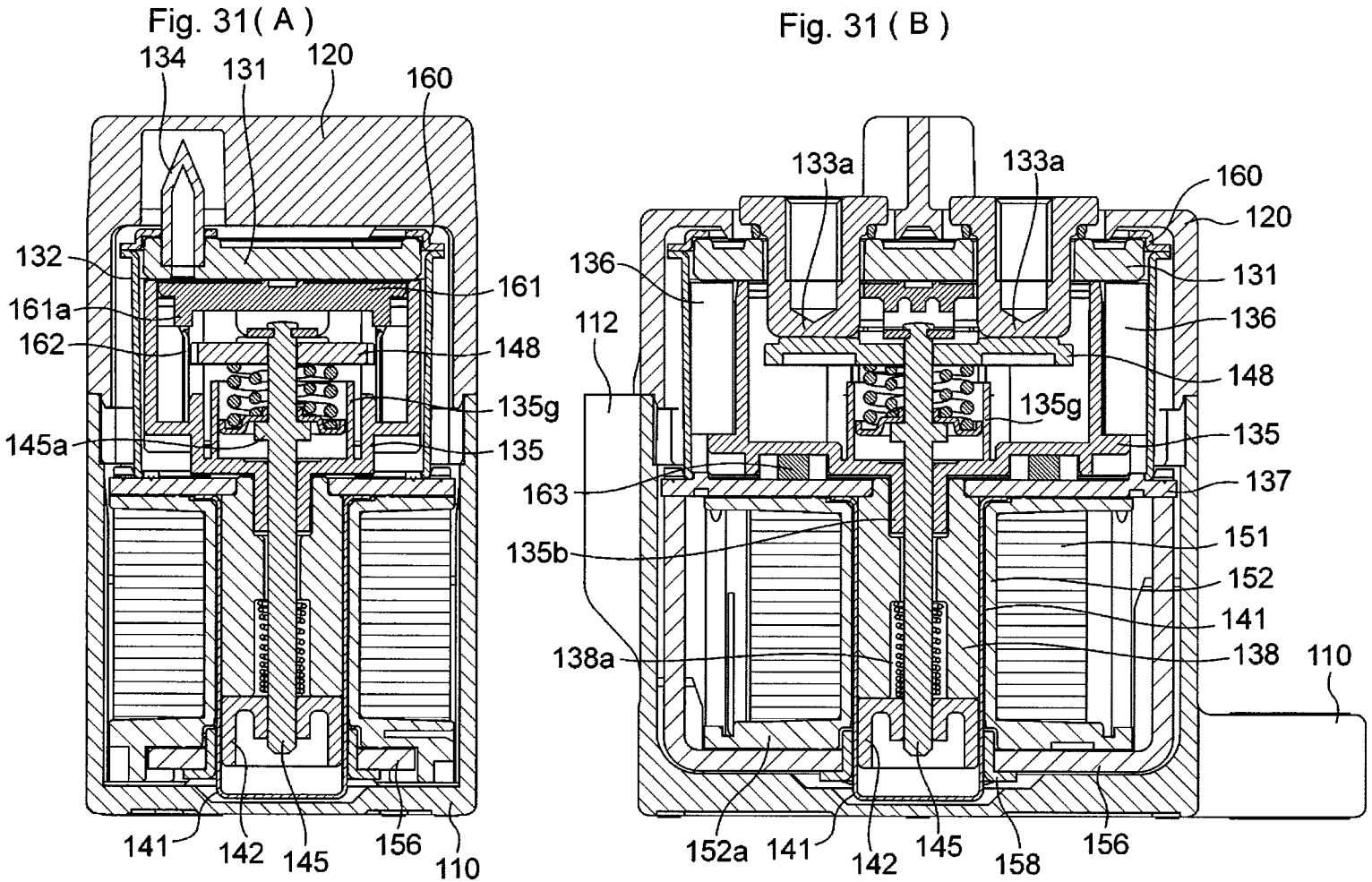
Fig. 31 ( B )
160
120
131
136
148
135
137
151
152
141
138
110
133a
135g
156
158
145
142
141
152a
133a
136
112
163
135b
138a
Fig. 31 ( A )
160
120
131
134
161
148
135g
135
110
156
145
142
141
132
161a
162
145a Fig. 32 ( A )
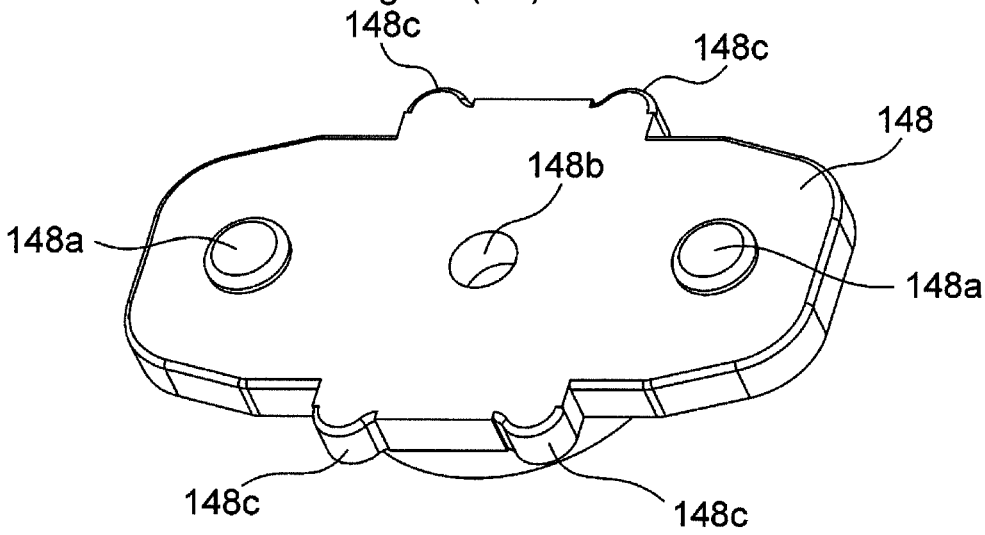
Fig. 32 ( B )
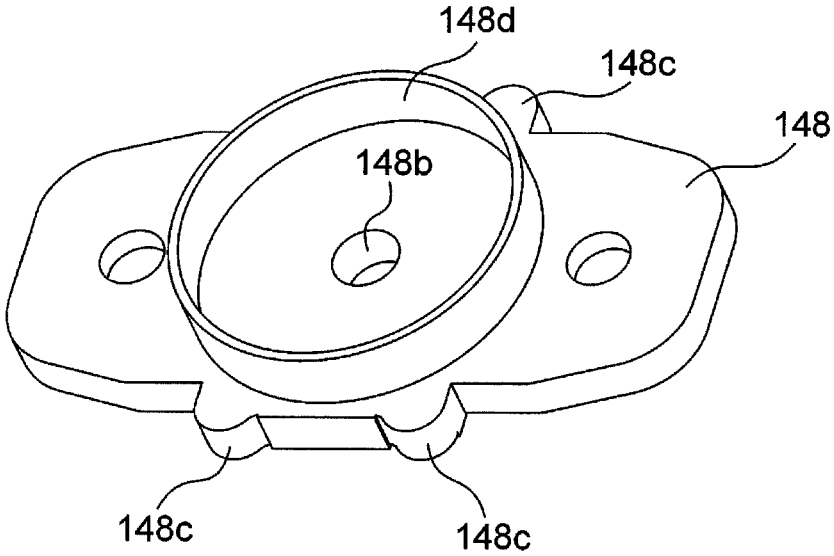

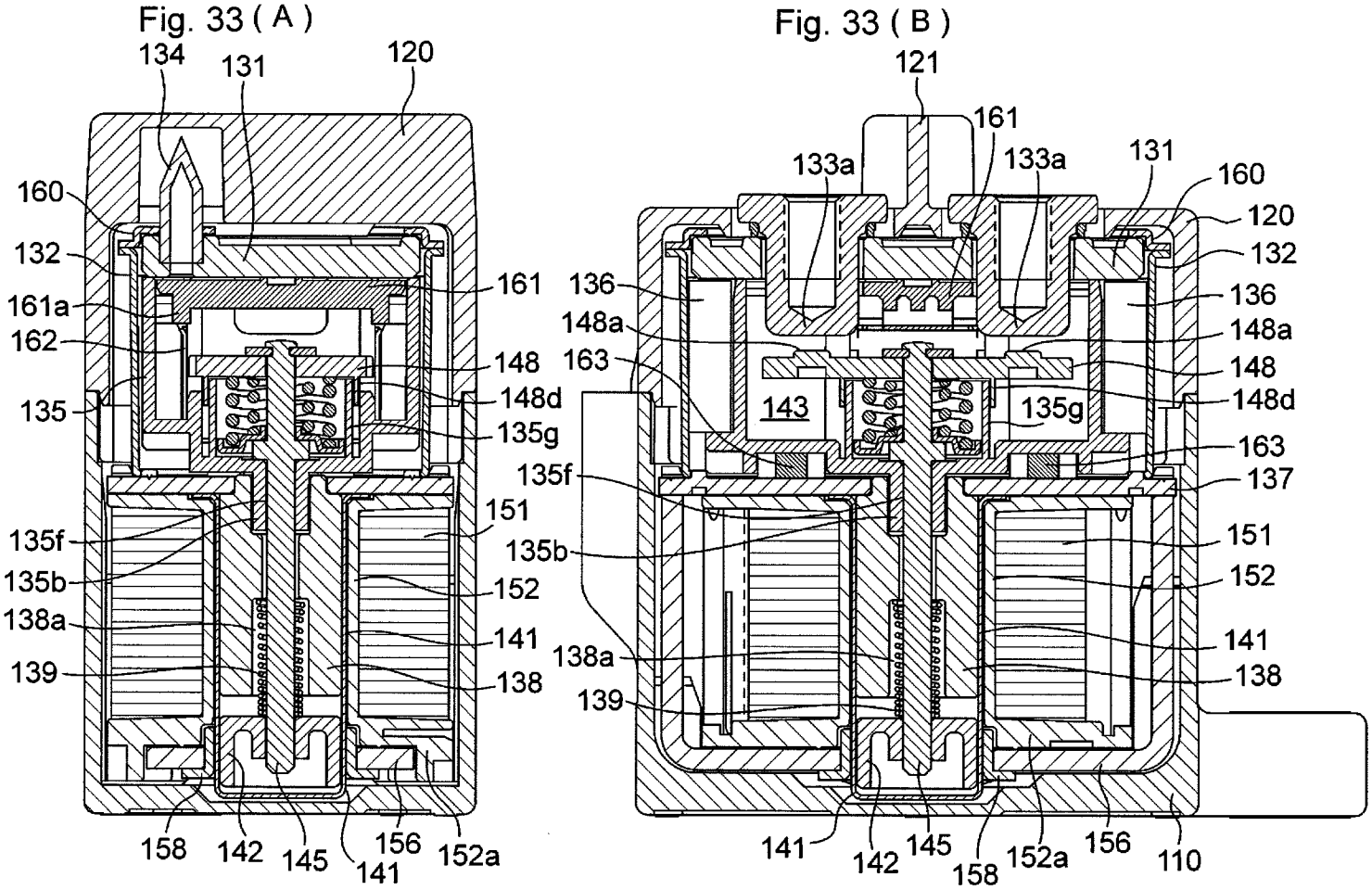
Fig. 33 ( B )
Fig. 33 ( A )
120
132
136
148a
148
148d
163
137
151
152
141
138
110
156
152a
158
145
142
141
160
131
133a
161
121
135g
143
135f
135b
138a
139
134
161a
162
135

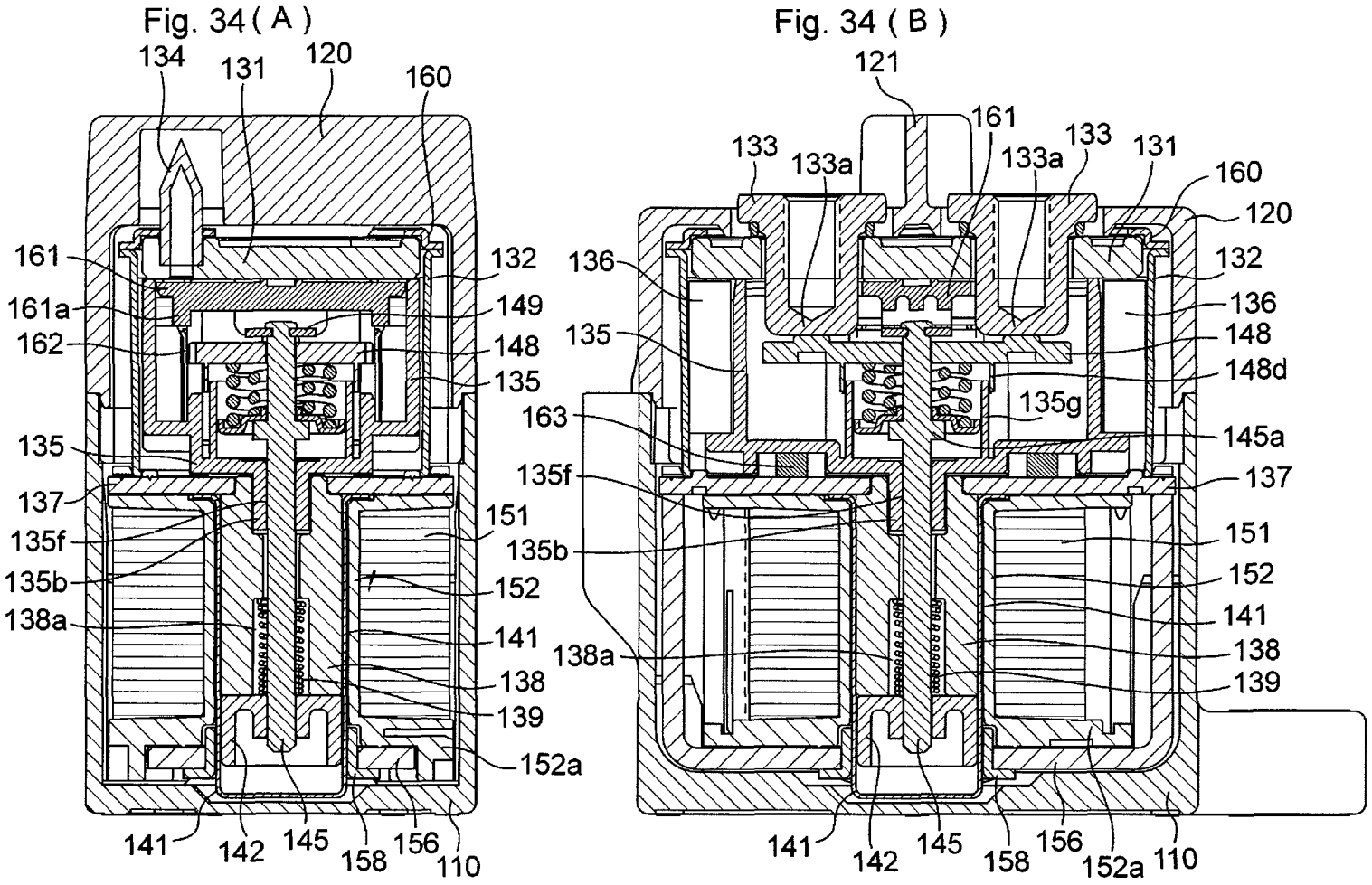
Fig. 34 ( B )
160
120
132
136
148
148d
145a
137
151
152
141
138
139
110
152a
156
158
145
142
141
131
133
133a
161
121
135g
133a
133
136
135
163
135f
135b
138a
Fig. 34 ( A )
160
120
131
134
132
149
148
135
151
135b
152
141
138
139
152a
110
156
158
145
142
141
161
161a
162
135
137
135f
135b
138a Fig. 37 ( A )
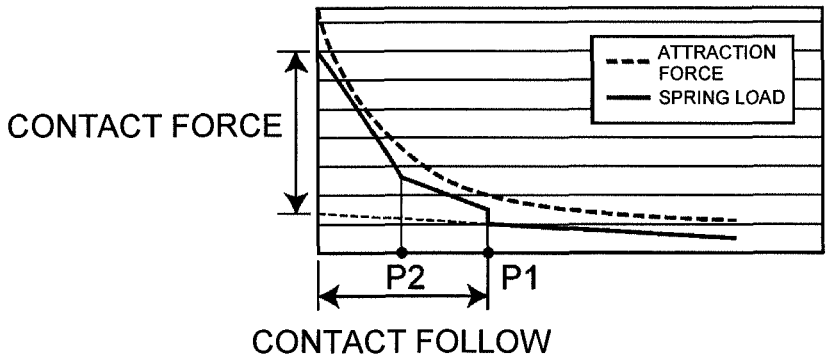
Fig. 37( B )
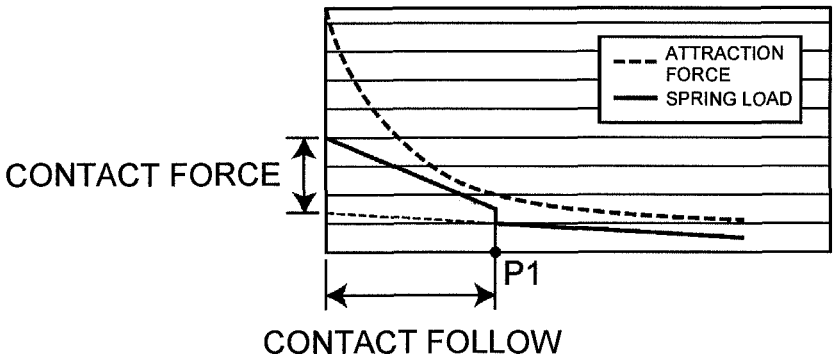
Fig. 37( C )
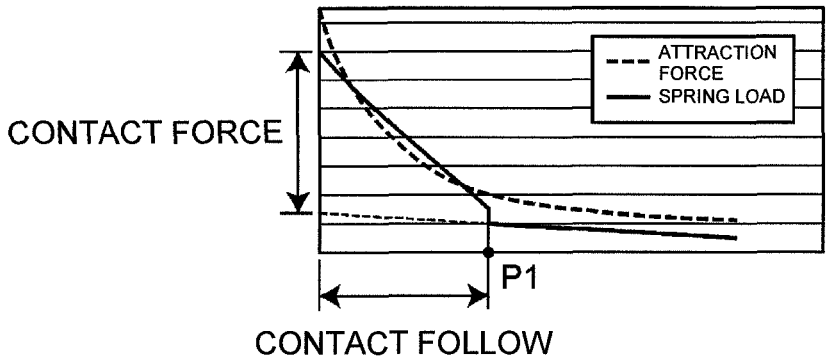
Fig. 37( D )
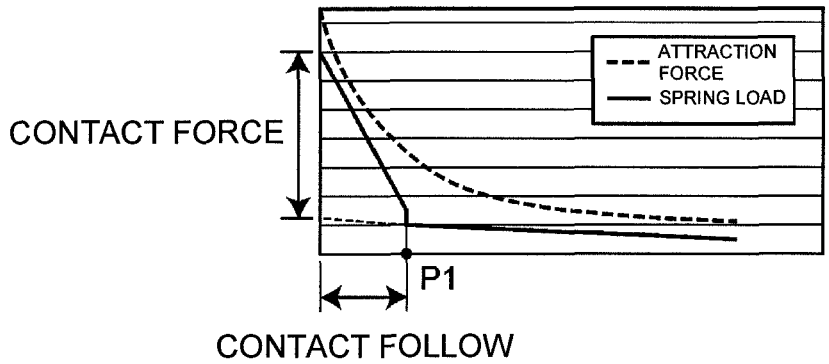

Fig. 38(A)
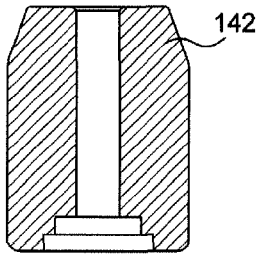
Fig. 38(B)
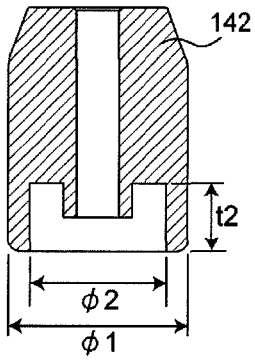
Fig. 38(C)
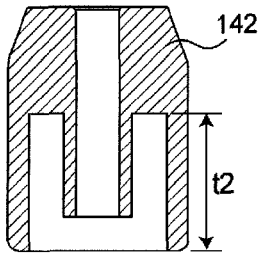
Fig. 38(D)
| WEIGHT RATIO | AVERAGE SOUND DIFFERENCE | OPERATING SOUND DIFFERENCE |
|---|---|---|
| 85%(B/A) | -2.10 | 97% |
| 68%(C/A) | -4.11 | 94% |
Fig. 38(E)
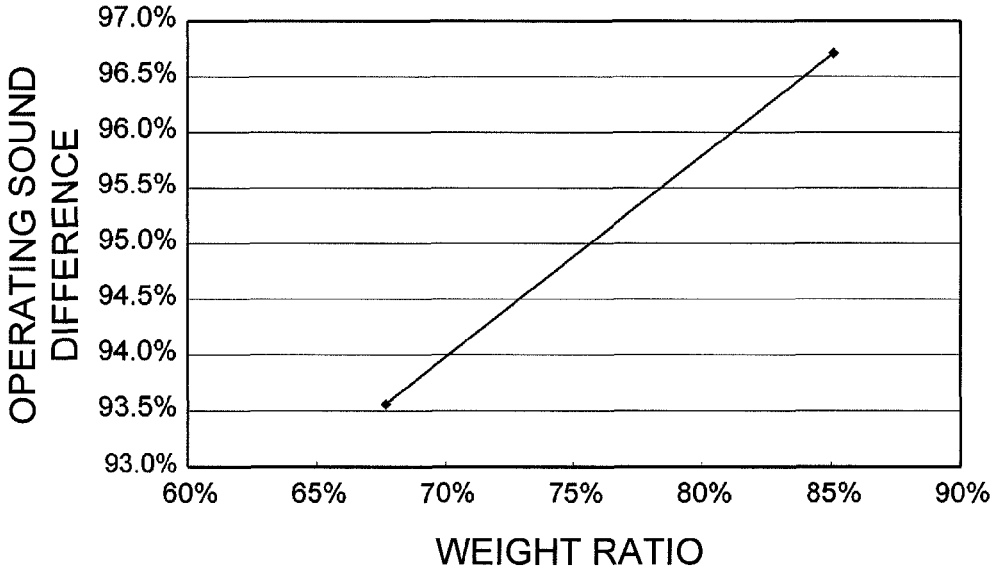

Fig. 39(A)
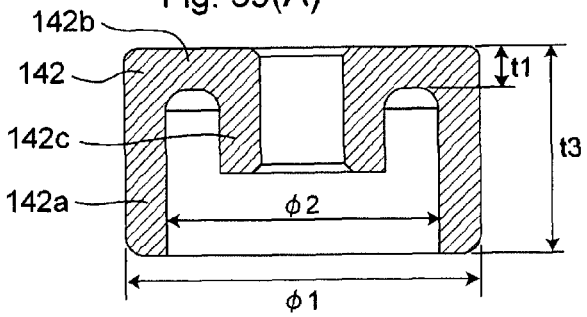
Fig. 39(B)
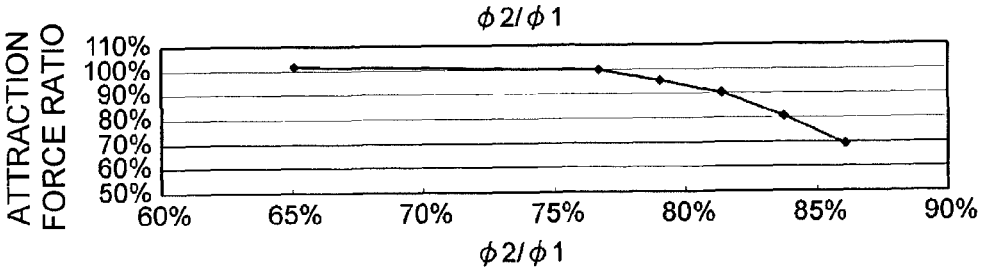
Fig. 39(C)
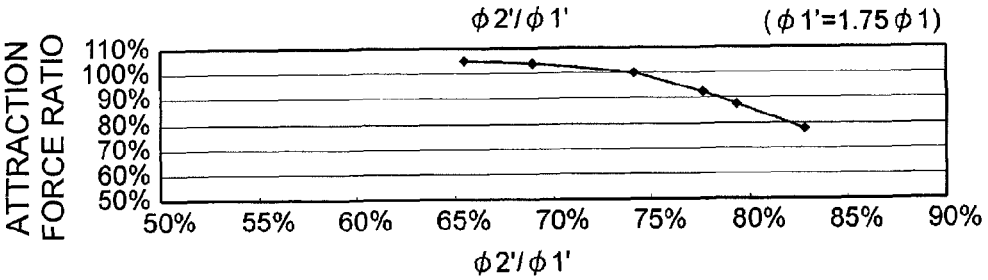
Fig. 39(D)
| t1 | ATTRACTION FORCE RATIO |
|---|---|
| 1/3×t3 | 100% |
| 1/4×t3 | 100% |
| 1/5×t3 | 100% |
| 1/6×t3 | 98% |

COIL TERMINAL

This is a non-provisional application claiming the benefit of International Application Number PCT/JP2011/055933 filed Mar. 14, 2011.

TECHNICAL FIELD

The present invention relates to a coil terminal, for example, a coil terminal that connects a coil wound around a spool making up an electromagnetic relay, and a lead wire.

BACKGROUND ART

Conventionally, as a coil terminal, for example, as described in Japanese Patent Application Laid-Open No. 2004-71510, there has been a coil terminal used in a switching device that drives a contact mechanism block contained inside a sealed case, which is airtightly sealed, by an electromagnet block arranged outside the sealed case, wherein magnetic pole portions which are one-end portions of a pair of iron cores making up the electromagnet block are arranged in a bottom surface of the sealed case, respectively, and other-end portions of the pair of iron cores are connected to each other by a yoke, and both end portions of a movable iron piece of the contact mechanism block are attracted and stuck to, and depart from the magnetic pole portions of the iron cores, respectively, based on excitation and degauss of the electromagnet block.

In the foregoing switching device, as shown in FIG. 2, coils 31 wound in spools 32 are connected to lead wires not shown through relay terminals 34, 35 and coil terminals 36, 36.

SUMMARY OF THE INVENTION

Problem to be Solved by the Invention

However, in the foregoing switching device, the relay terminals 34, 35 and the coil terminals 36 are needed for connecting the coils 31 and the lead wires not shown. Therefore, numbers of components and assembling man hours are large, which makes productivity lower.

Moreover, in the foregoing switching device, a lead-out line of each of the coils is entwined around an entwining portion of each of the terminals to be soldered, and the lead wire is then entwined to be soldered. Thus, there is a problem that the coil is disconnected when the lead wire is entwined, or that the solder of the coil is melted when the lead wire is soldered, so that the coil becomes slack.

The present invention is devised in light of the above-described problem, and an object of the present invention is to provide a coil terminal having smaller numbers of components and assembling man hours, and thus higher productivity, in which disconnection and slackness of a coil do not occur.

Means for Solving the Problem

In order to solve the above-described problem, a coil terminal according to the present invention is a coil terminal in which a press-fitting portion is pressed into a press-fitting groove provided at a corner portion of a flange portion of a spool with a coil wound therearound, and a lead-out line of the coil is entwined around a coil entwining portion projected from the flange portion, and the coil entwining portion is bent and raised, wherein the coil entwining portion extends in an opposite direction of a press-fitting direction of the press-fitting portion so as to be able to be bent and raised, and a lead wire connecting portion extends laterally to the press-fitting direction so as to be able to be bent and raised.

Effect of the Invention

According to the present invention, extending the coil entwining portion and the lead wire connecting portion enables a coil wire and a lead wire to be entwined and connected separately, which reduces components and assembling man hours in number, so that the coil terminal having higher productivity can be obtained.

Moreover, since the coil entwining portion and the lead wire connecting portion extend in the different directions so as to be able to be bent and raised, the coil wire and the lead wire do not disturb each other when entwined, so that the coil terminal enabling easy work can be obtained.

Furthermore, when the press-fitting portion of the coil terminal of the present application is pressed into the press-fitting groove provided at the corner portion of the spool, and the coil entwining portion and the lead wire connecting portion are bent and raised, the coil entwining portion and the lead wire connecting portion stand up from adjacent sides of the flange portion, respectively. Thus, a predetermined distance can be assured between the coil entwining portion and the lead wire connecting portion, so that the occurrence of the disconnection and the slackness of the coil can be avoided.

According to the embodiment of the present invention, a lead wire entwining portion may extend in a direction orthogonal to the press-fitting direction of the press-fitting portion so as to be able to be bent and raised.

According to the present embodiment, when the coil entwining portion and the lead wire connecting portion are bent and raised, the coil entwining portion and the lead wire connecting portion stand up parallel from adjacent sides of the flange portion, and are put into an adjacent state. Thus, the predetermined distance can be assured between the coil entwining portion and the lead wire connecting portion, so that the occurrence of the disconnection and the slackness of the coil can be avoided.

Obviously, an angle between the coil entwining portion and the lead wire connecting portion is not limited to a right angle, but may be, for example, 60 degrees or 120 degrees.

According to a different embodiment of the present invention, a retaining projection may be cut and raised in the press-fitting portion.

According to the present embodiment, the coil terminal that does not come off from the press-fitting groove of the flange portion of the spool can be obtained.

As a different embodiment according to the present invention, a hole for lead wire insertion and a cut-out portion for entwining may be provided adjacently at a free end portion of the lead wire connecting portion.

According to the present embodiment, since the lead wire can be inserted into the hole for lead wire insertion to be temporarily jointed, and then, the lead wire can be entwined around the cut-out portion for entwining to be soldered, proficiency is not needed, so that the coil terminal having high workability can be obtained.

As an embodiment according to the present invention, a cutter surface may be formed at a free end portion of the coil entwining portion.

According to the present embodiment, there is an effect that the lead-out line of the entwined coil can be easily cut by the cutter surface provided in the coil entwining portion, and that auto assembling is thus easy.

BRIEF DESCRIPTION OF THE DRAWINGS

FIGS. 1A, 1B and 1C are an overall perspective view, a plan view and a side view showing one embodiment of a contact switching device according to the present invention.

FIGS. 3A, 3B and 3C are a perspective view, a cross-sectional view and a perspective view when seen from a different angle of a magnet holder shown in FIG. 2.

FIGS. 4A and 4B are a side cross-sectional view and a front cross-sectional view before operation of the contact switching device shown in FIGS. 1.

FIGS. 5A and 5B are a side cross-sectional view and a front cross-sectional view after operation of the contact switching device shown in FIGS. 1.

FIGS. 26A and 26B are a perspective view and a plan view each showing a horizontal cross section of the contact switching device shown in FIG. 6.

FIGS. 28A and 28B are perspective views when a magnet holder of a contact switching device according to a third embodiment of the present invention is seen from different angles.

FIGS. 30A and 30B are a side cross-sectional view and a front cross-sectional view before operation of the contact switching device according to the third embodiment.

FIGS. 31A and 31B are a side cross-sectional view and a front cross-sectional view after operation of the contact switching device according to the third embodiment.

FIGS. 32A and 32B are perspective views when a movable contact piece of a contact switching device according to a fourth embodiment of the present invention is seen from different angles.

FIGS. 33A and 33B are a side cross-sectional view and a front cross-sectional view before operation of the contact switching device according to the fourth embodiment of the present invention.

FIGS. 34A and 34B are a side cross-sectional view and a front cross-sectional view after operation of the contact switching device according to the fourth embodiment of the present invention.

FIGS. 37A, 37B, 37C, and 37D are graph charts showing attraction force characteristics of contact switching devices according to the present invention and a conventional example (comparative example).

FIGS. 38A, 38B, and 38C are cross-sectional views of a movable iron core, FIG. 38D is a chart showing measurement results regarding reduction in operating sound, and FIG. 38E is a graph chart showing the measurement results.

FIG. 39A is a cross-sectional view of the movable iron core, FIGS. 39B and 39C are graph charts showing measurement results of an attraction force, and FIG. 39D is a chart showing the measurement results of the attraction force.

DETAILED DESCRIPTION OF THE INVENTION

Figure 2:
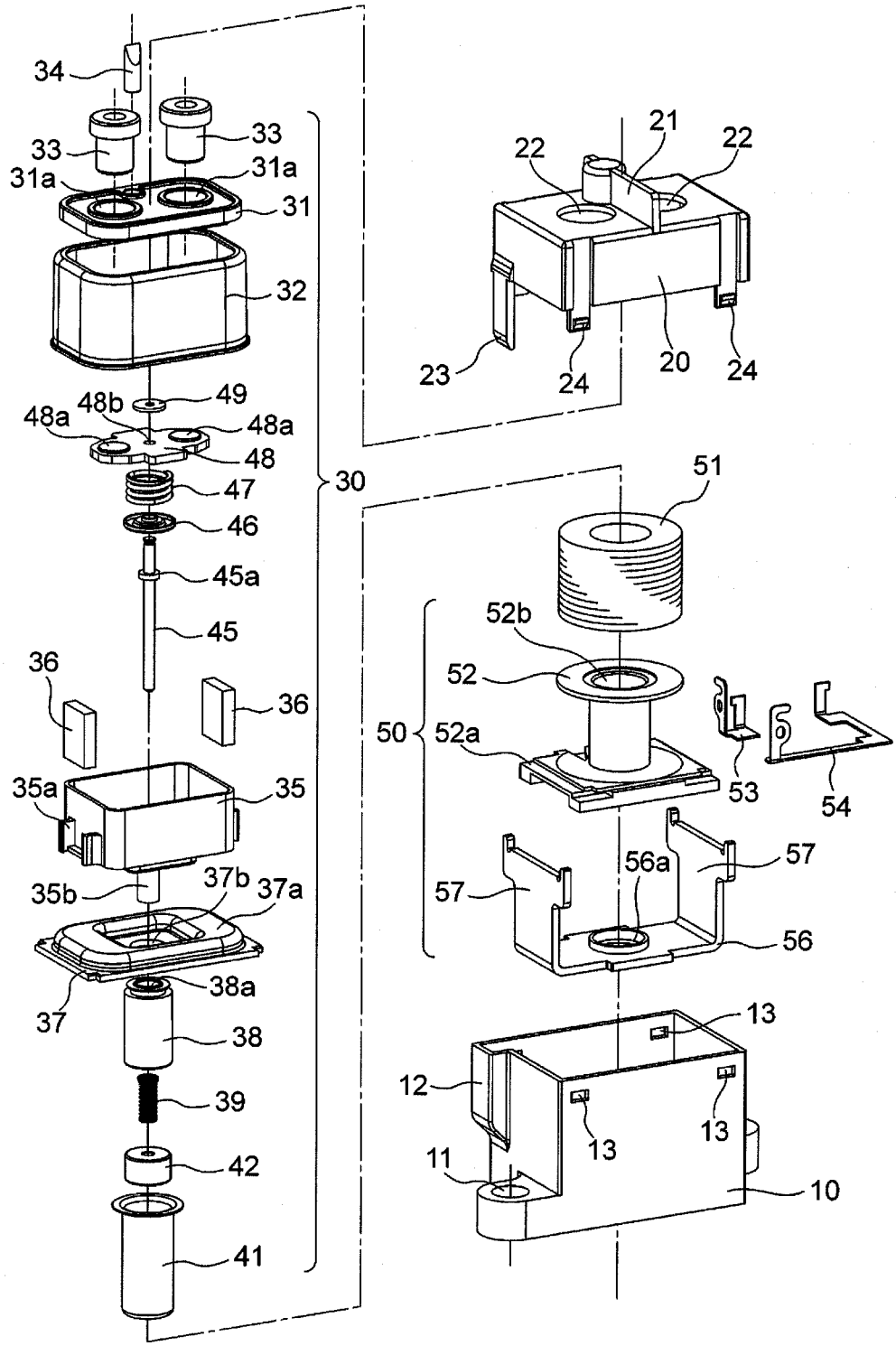
FIG. 2 is an exploded perspective view of the contact switching device shown in FIGS. 1.
Figure 6:
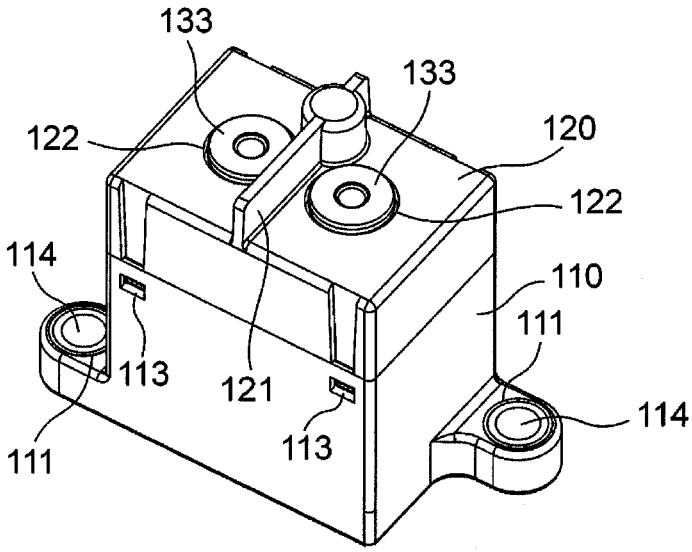
FIGS. 6A, 6B and 6C are an overall perspective view, a plan view and a side view showing a second embodiment of a contact switching device according to the present invention.
Figure 6:
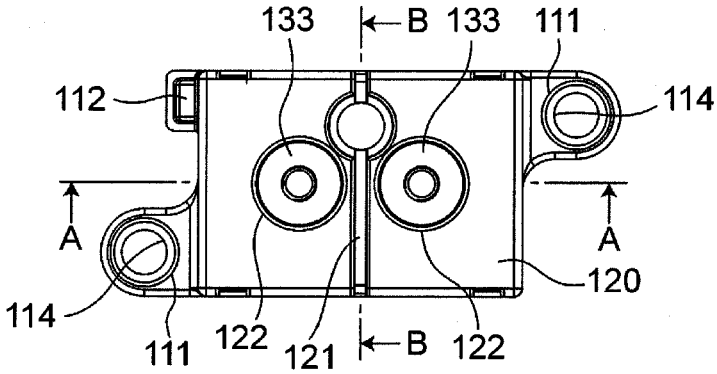
Figure 6:
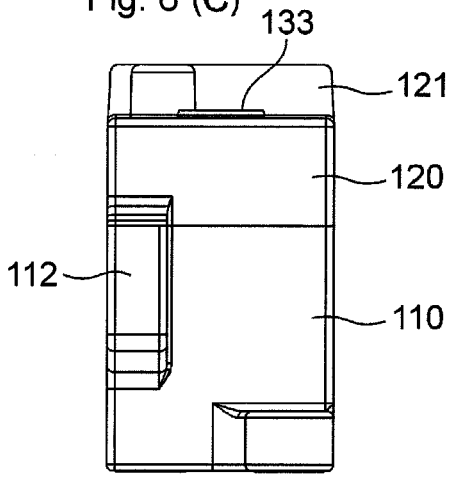

Embodiments of a sealed electromagnetic relay as a contact switching device to which a coil terminal according to the present invention is applied will be described with reference to the accompanying drawings of FIGS. 1 to 36.

As illustrated in FIGS. 1 to 5, a sealed electromagnetic relay according to a first embodiment contains, inside a housing formed by assembling a cover 20 to a case 10, a contact mechanical portion 30 incorporated in a sealed space 43 made by a ceramic plate 31, a metal cylindrical flange 32, a plate-like first yoke 37 and a bottomed cylindrical body 41, and an electromagnet portion 50 that drives this contact mechanical portion 30 from an outside of the sealed space 43.

The case 10 is a substantially box-shaped resin molded article, in which attachment holes 11 are provided in lower corner portions of outer side surfaces, while a bulging portion 12 to lead out a lead wire not shown is formed in a side-surface corner portion, and locking holes 13 are provided in opening edge portions in opposed side surfaces.

The cover 20 has a shape that can cover an opening portion of the case 10, and terminal holes 22, 22 are respectively provided on both sides of a partition wall 21 projected in an upper-surface center thereof. Moreover, in the cover 20, there is provided, in one side surface, a projected portion 23 that is inserted into the bulging portion 12 of the case 10 to be able to prevent so-called fluttering of the lead wire not shown. Furthermore, in the cover 20, locking claw portions 24 that can be locked in the locking holes 13 of the case 10 are provided in opening edge portions of opposed side surfaces.

As described before, the contact mechanical portion 30 is arranged inside the sealed space 43 formed by the ceramic plate 31, the metal cylindrical flange 32, the plate-like first yoke 37 and the bottomed cylindrical body 41, and is made up of a magnet holder 35, a fixed iron core 38, a movable iron core 42, a movable shaft 45 and a movable contact piece 48.

The ceramic plate 31 has a shape that can be brazed to an upper opening edge portion of the metal cylindrical flange 32 described later, and is provided with a pair of terminal holes 31*a* and 31*a* and a vent hole 31*b* (refer to FIGS. 4A, 5A). In the ceramic plate 31, a metal layer not shown is formed in an outer circumferential edge portion of an upper surface thereof, opening edge portions of the terminal holes 31*a*, and an opening edge portion of the vent hole 31*b*, respectively. As shown in FIGS. 4 and 5, fixed contact terminals 33 to which fixed contacts 33*a* adhere at lower end portions thereof are brazed to the terminal holes 31*a* of the ceramic plate 31, and a vent pipe 34 is brazed to the vent hole 31*b*.

As shown in FIG. 2, the metal cylindrical flange 32 brazed to an upper-surface circumferential edge portion of the ceramic plate 31 has a substantially cylindrical shape formed by subjecting a metal plate to press working. As to the metal cylindrical flange 32, a lower outer circumferential portion thereof is welded to, and integrated with the plate-like first yoke 37 described later.

The magnet holder 35 contained in the metal cylindrical flange 32 is made of a thermally-resistant insulating material having a box shape, as shown in FIG. 3, and is formed with pocket portions 35*a* capable of holding permanent magnets 36 on opposed both outer side surfaces, respectively. In the magnet holder 35, an annular cradle 35*c* is provided in a bottom-surface center thereof so as to be one-step lower, and a cylindrical insulating portion 35*b* is projected downward from a center of the annular cradle 35*c*. In the cylindrical insulating portion 35*b*, even if arc is generated, and a high voltage is caused in a channel of the metal cylindrical flange 32, the plate-like first yoke 37 and the fixed iron core 38, insulating the cylindrical fixed iron core 38 and the movable shaft 45 from each other prevents both from melting and adhering to, and being integrated with each other.

As shown in FIG. 2, the plate-like first yoke 37 has a shape that can be fitted in an opening edge portion of the case 10, and an annular step portion 37*a* is formed in an upper surface thereof by protrusion process, and a caulking hole 37*b* is provided in a center thereof. In the plate-like first yoke 37, an upper end portion of the cylindrical fixed iron core 38 is fixed to the caulking hole 37*b* by caulking, while a lower opening portion of the metal cylindrical flange 32 is fitted on the annular step portion 37*a* to be welded and integrated from outside.

According to the present invention, the metal cylindrical flange 32 is fitted on the annular step portion 37*a* from above, which enables both to be positioned precisely and easily.

Moreover, the lower opening edge portion of the metal cylindrical flange 32 is welded and integrated with the annular step portion 37*a* of the plate-like first yoke 37 from outside. Therefore, the present embodiment has an advantage that wide lateral welding margins are not required, thereby resulting in the contact switching device with a small floor area.

As to the cylindrical iron core 38, the movable shaft 45 with an annular flange portion 45*a* is inserted into a through-hole 38*a* so as to move slidably through the cylindrical insulating portion 35*b* of the magnet holder 35. A return spring 39 is put on the movable shaft 45, and the movable iron core 42 is fixed to a lower end portion of the movable shaft 45 by welding.

As to the bottomed cylindrical body 41 containing the movable iron core 42, an opening edge portion thereof is airtightly bonded to a lower-surface edge portion of the caulking hole 37*b* provided in the plate-like first yoke 37. After internal air is suctioned from the vent pipe 34, gas is charged and sealing is performed, by which the sealed space 43 is formed.

In the movable shaft 45, as shown in FIG. 4, a disk-like receiver 46 is locked by the annular flange portion 45*a* provided at an intermediate portion of the movable shaft 45 to thereby prevent a contact spring 47 and the movable contact piece 48, which have been put on the movable shaft 45, from coming off, and a retaining ring 49 is fixed to an upper end portion. Movable contacts 48*a* provided in upper-surface both end portions of the movable contact piece 48 are opposed to the fixed contacts 33*a* of the contact terminals 33 arranged inside the metal cylindrical flange 32 so as to be able to contact and depart from the fixed contacts 33*a*.

As shown in FIG. 2, in the electromagnet portion 50, coil terminals 53 and 54 are pressed into, and fixed to a flange portion 52*a* of a spool 52 which the coil 51 is wound around, and the coil 51 and lead wires not shown are connected through the coil terminals 53 and 54. The bottomed cylindrical body 41 is inserted into a through-hole 52*b* of the spool 52, and is fitted in a fitting hole 56*a* of a second yoke 56. Subsequently, upper end portions of both side portions 57 and 57 of the second yoke 56 are engaged with both end portions of the plate-like first yoke 37, and are fixed by means of caulking, press-fitting, welding or the like, by which the electromagnet portion 50 and the contact mechanical portion 30 are integrated.

Next, operation of the sealed electromagnetic relay constituted as described above will be described.

First, as shown in FIG. 4, when a voltage is not applied to the coil 51, the movable iron core 42 is biased downward by a spring force of the return spring 39, so that the movable shaft 45 is pushed downward, and the movable contact piece 48 is pulled downward. At this time, although the annular flange portion 45*a* of the movable shaft 45 is engaged with the annular receiving portion 35*c* of the magnet holder 35, so that the movable contacts 48*a* depart from the fixed contacts 33*a*, the movable iron core 42 does not abut on the bottom surface of the bottomed cylindrical body 41.

Subsequently, when the voltage is applied to the coil 51 to excite the same, as illustrated in FIG. 5, the movable iron core 42 is attracted by the fixed iron core 38, so that the movable shaft 45 slides and moves upward against the spring force of the return spring 39. Even after the movable contacts 48*a* come into contact with the fixed contacts 33*a*, the movable shaft 45 is pushed up against spring forces of the return spring 39 and the contact spring 47. This allows the upper end portion of the movable shaft 45 to be projected from a shaft hole 48*b* of the movable contact piece 48, so that the movable iron core 42 is attracted and stuck to the fixed iron core 38.

When the application of the voltage to the coil 51 is stopped to release the excitation, the movable iron core 42 departs from the fixed iron core 38, based on the spring forces of the contact spring 47 and the return spring 39. This allows the movable shaft 45 to slide and move downward, so that the movable contacts 48*a* depart from the fixed contacts 33*a*, and then, the annular flange portion 45*a* of the movable shaft 45 is engaged with the annular cradle 35*c* of the magnet holder 35, thereby returning to an original state (FIG. 4).

According to the present embodiment, even when the movable shaft 45 returns to the original state, the movable iron core 42 does not abut on the bottom surface of the bottomed cylindrical body 41. Therefore, the present embodiment has an advantage that impact sound is absorbed and alleviated by the magnet holder 35, the fixed iron core 38, the electromagnet portion 50 and the like, thereby resulting in the sealed electromagnetic relay having small switching sound.

As illustrated in FIGS. 6 to 27, a sealed electromagnetic relay according to a second embodiment contains, inside a housing formed by assembling a cover 120 to a case 110, a contact mechanical portion 130 incorporated in a sealed space 143 made by a metal frame body 160, a ceramic plate 131, a metal cylindrical flange 132, a plate-like first yoke 137 and a bottomed cylindrical body 141, and an electromagnet portion 150 that drives the contact mechanical portion 130 from an outside of the sealed space 143.

Figure 7:
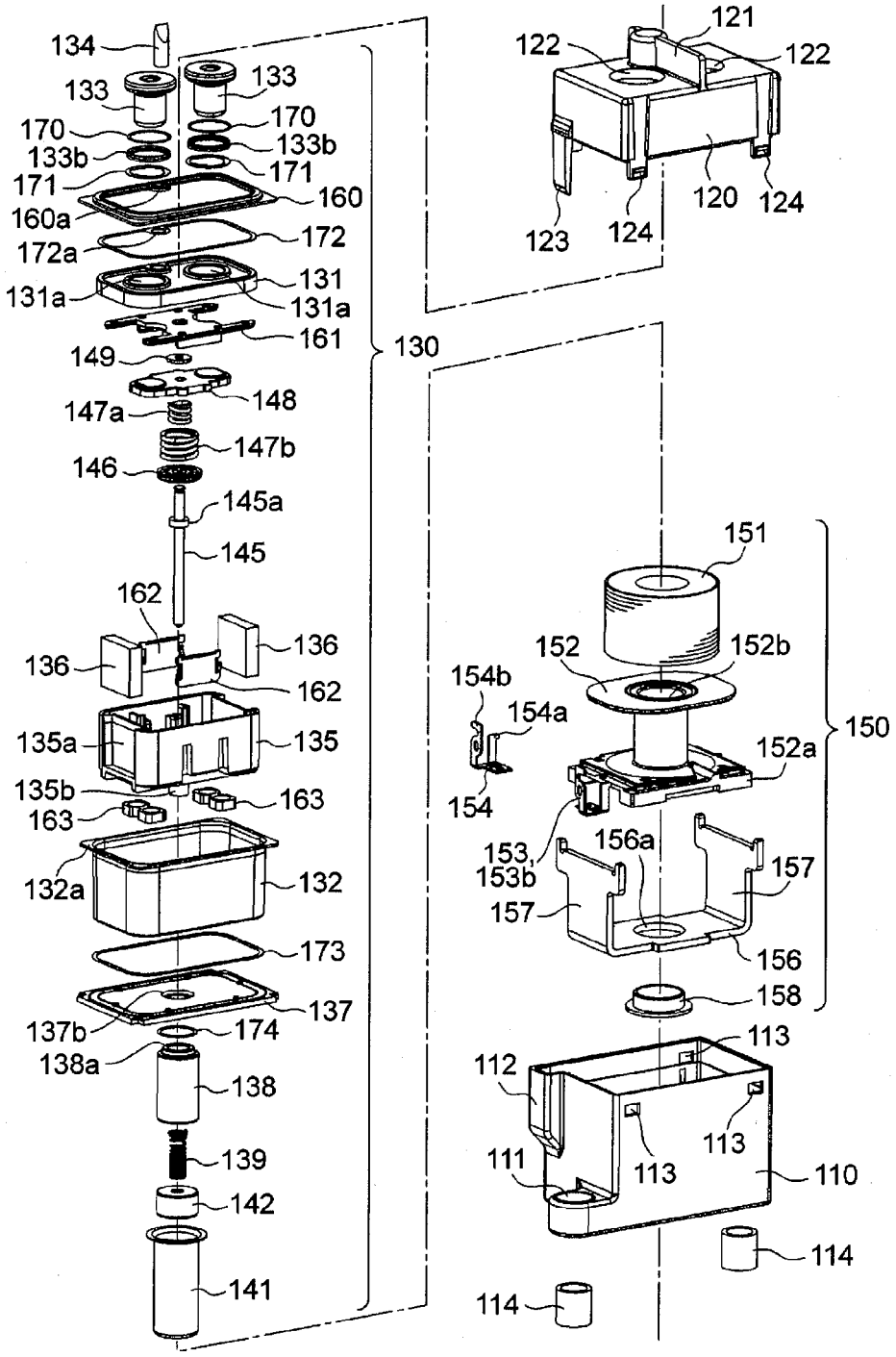
FIG. 7 is an exploded perspective view when the contact switching device shown in FIG. 6 is seen from above.

As shown in FIG. 7, the case 110 is a substantially box-shaped resin molded article, in which attachment holes 111 are provided in lower corner portions of outer side surfaces, while a bulging portion 112 to lead out a lead wire not shown is formed in a side-surface corner portion, and locking holes 113 are provided in opening edge portions in opposed side surfaces. In the attachment holes 111, cylindrical clasps 114 are insert-molded.

As shown in FIG. 7, the cover 120 has a shape that can cover an opening portion of the case 110, and terminal holes 122, 122 are respectively provided on both sides of a partition wall 121 projected in an upper-surface center thereof. Moreover, in the cover 120, there is provided, in one side surface, a projected portion 123 that is inserted into the bulging portion 112 of the case 110 to be able to prevent so-called fluttering of the lead wire not shown. Furthermore, in the cover 120, locking claw portions 124 that can be locked in the locking holes 113 of the case 110 are provided in opening edge portions of opposed side surfaces.

As described before, the contact mechanical portion 130 is arranged inside the sealed space 143 formed by the metal frame body 160, the ceramic plate 131, the metal cylindrical flange 132, the plate-like first yoke 137 and the bottomed cylindrical body 141. The contact mechanical portion 130 is made up of a magnet holder 135, a fixed iron core 138, a movable iron core 142, a movable shaft 145, a movable contact piece 148, and a lid body 161.

Figure 9:
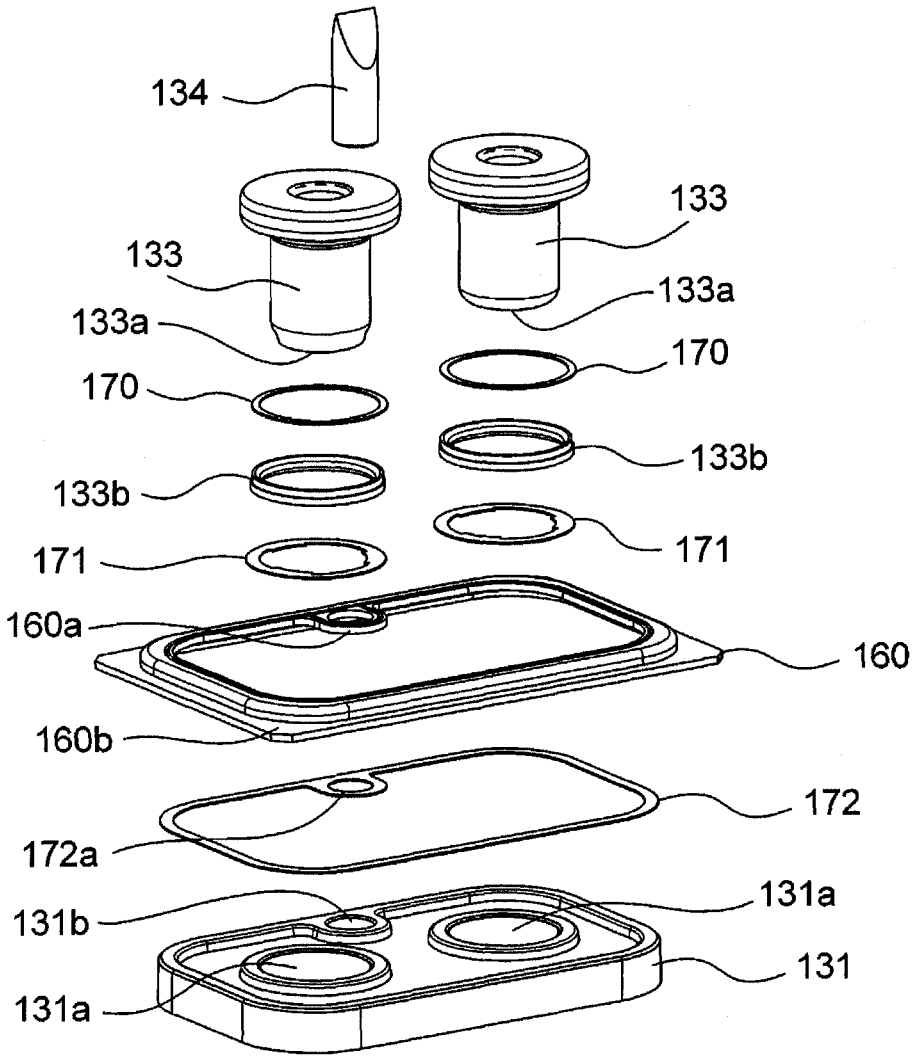
FIG. 9 is a partially enlarged view of the exploded perspective view shown in FIG. 7.

As shown in FIG. 9, the metal frame body 160 has a shape that can be brazed to an upper-surface outer circumferential edge portion of the ceramic plate 131 described later. The metal frame body 160 has a ring portion 160*a* to support a vent pipe 134 described later in an inner edge portion thereof, and an outer circumferential rib 160*b* to be welded to an opening edge portion of the metal cylindrical flange 132 described later in an outer circumferential edge portion thereof.

As shown in FIG. 9, the ceramic plate 131 has a shape that allows the upper-surface outer circumferential edge portion of the ceramic plate 131 to be brazed to an opening edge portion of the metal frame body 160, and is provided with a pair of terminal holes 131*a*, 131*a* and a vent hole 131*b*. In the ceramic plate 131, a metal layer not shown is formed in the upper-surface outer circumferential edge portion thereof, opening edge portions of the terminal holes 131*a*, and an opening edge portion of the vent hole 131*b*, respectively.

In the upper-surface outer circumferential edge portion of the ceramic plate 131 and the opening edge portion of the vent hole 131*b*, a rectangular frame-shaped brazing material 172 including a ring portion 172*a* corresponding to the opening edge portion of the vent hole 131*b* is arranged. Furthermore, the ring portion 160*a* of the metal frame body 160 is overlaid on the ring portion 172*a* of the rectangular frame-shaped brazing material 172 to perform positioning. The vent pipe 134 is inserted into the ring portion 160*a* of the metal frame body 160 and the vent hole 131*b* of the ceramic plate 131. Furthermore, the fixed contact terminals 133 on which ring-shaped brazing materials 170, rings for terminals 133*b*, and ring-shaped brazing materials 171 are sequentially put are inserted into the terminal holes 131*a* of the ceramic plate 131. Subsequently, the foregoing brazing materials 170, 171, and 172 are heated and melted to perform the brazing.

The fixed contact terminals 133 inserted into the terminal holes 131*a* of the ceramic plate 131 through the rings for terminal 133*b* have the fixed contacts 133*a* adhered thereto at lower end portions.

The rings for terminal 133*b* are to absorb and adjust a difference in a coefficient of thermal expansion between the ceramic plate 131 and the fixed contact terminals 133.

Moreover, in the present embodiment, the vent pipe 134 inserted into the terminal hole 131*a* of the ceramic plate 131 is brazed through the ring portion 160*a* of the metal frame body 160 and the ring 172*a* of the rectangular frame-shaped brazing member 172. This enhances sealing properties, thereby resulting in the contact switching device having a sealed structure excellent in mechanical strength, particularly in impact resistance.

Figure 8:
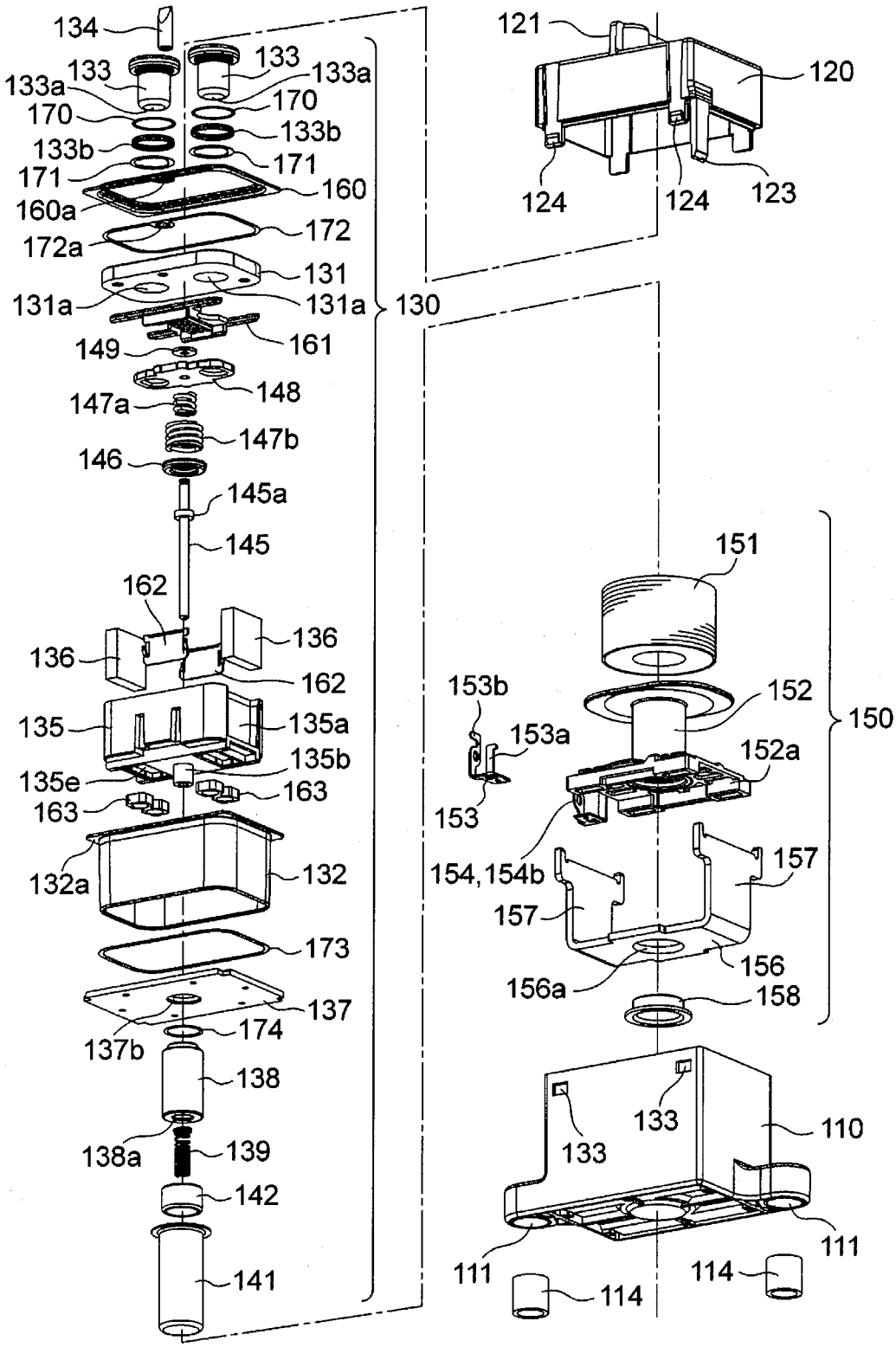
FIG. 8 is an exploded perspective view when the contact switching device shown in FIG. 6 is seen from underneath.
Figure 21A:
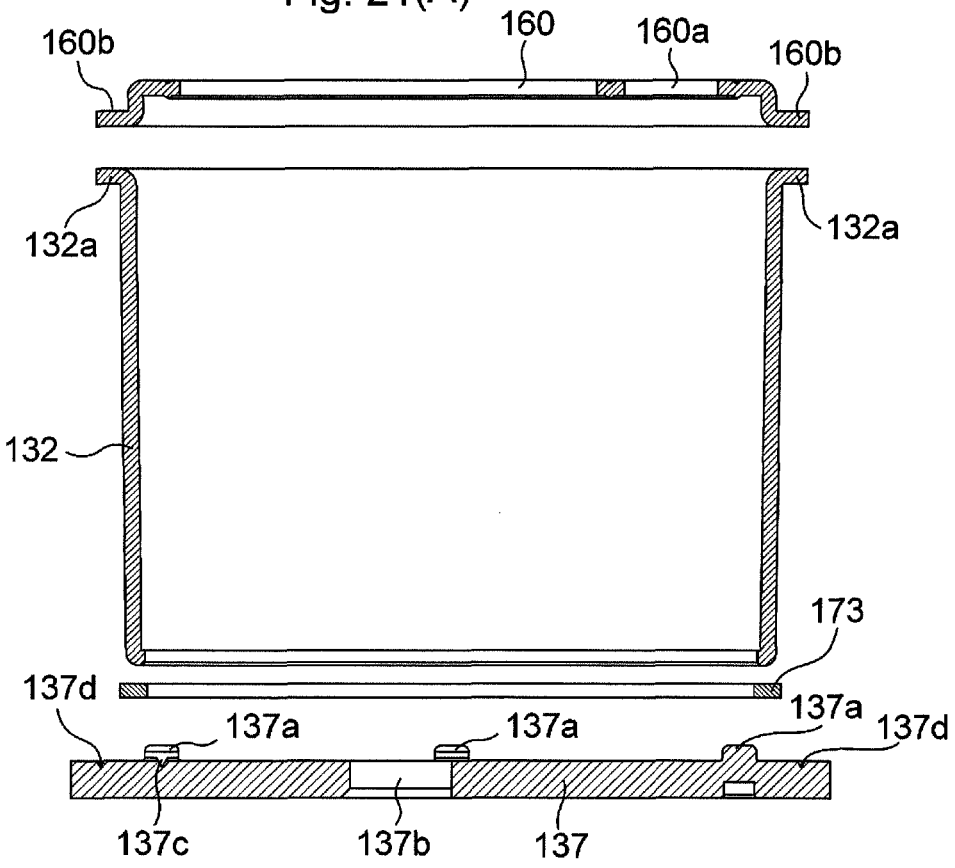
FIG. 21A is a cross-sectional view for describing an assembling method of the plate-like first yoke, a metal cylindrical flange and a metal frame body.
Figure 21:
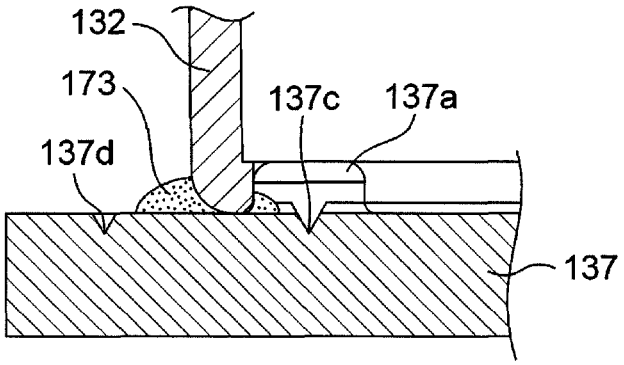
FIG. 21B is a main-part enlarged cross-sectional view after assembling.

As shown in FIGS. 7 and 8, the metal cylindrical flange 132 has a substantially cylindrical shape formed by subjecting a metal plate to press working. As shown in FIG. 21A, in the metal cylindrical flange portion, an outer circumferential rib 132*a* provided in an upper opening portion of the metal cylindrical flange portion is welded to, and integrated with the outer circumferential rib 160*b* of the metal frame body 160, and an opening edge portion on a lower side thereof is welded to, and integrated with the plate-like first yoke 137 described later.

The structure may be such that the metal frame body 160 and the metal cylindrical flange 132 are integrally molded by press working in advance, and an outer circumferential rib provided in a lower opening portion of the metal cylindrical flange portion 132 may be welded to, and integrated with an upper surface of the plate-like first yoke 137. According to the present constitution, not only the foregoing outer circumferential rib 160*b* of the metal frame body 160 and the outer circumferential rib 132*a* of the metal cylindrical flange 132 can be omitted, but welding processes of them can be omitted. Furthermore, since the metal cylindrical flange 132 and the plate-like first yoke 137 can be welded vertically, the welding process can be simplified as compared with a method of welding from outside, which brings about the contact switching device high in productivity.

Figure 17:
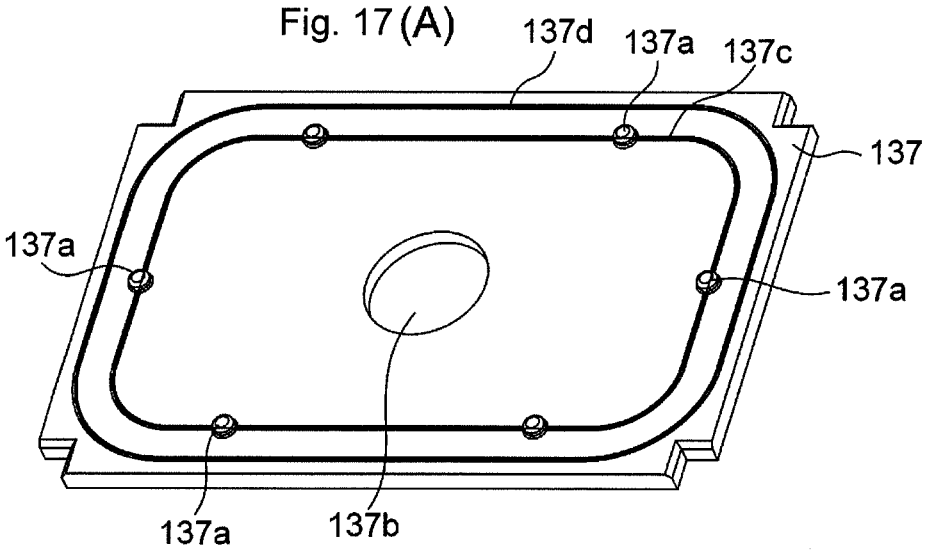
FIGS. 17A, 17B and 17C are a perspective view, a front view and an enlarged cross-sectional view along C-C line in FIG. 17B of a plate-like first yoke shown in FIGS. 7 and 8.
Figure 17:
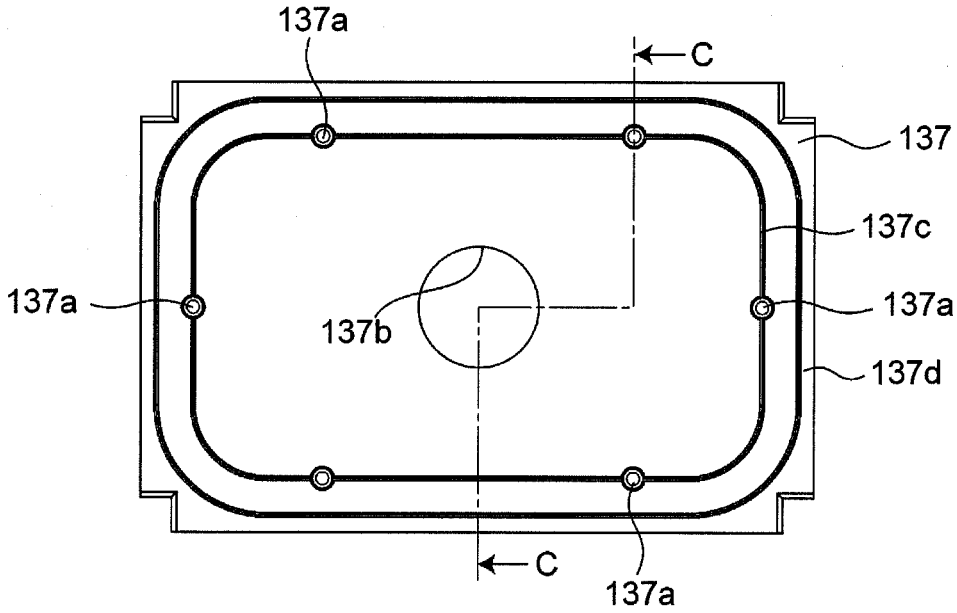
Figure 17C:
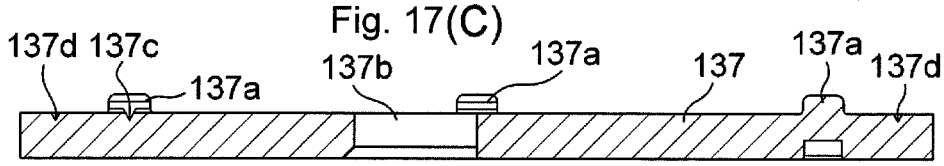

As shown in FIG. 7, the plate-like first yoke 137 has a shape that can be fitted in an opening edge portion of the case 110. As shown in FIG. 17, in the plate-like first yoke 137, positioning projections 137*a* are provided with a predetermined pitch on an upper surface thereof, and a fitting hole 137*b* is provided in a center thereof.

Moreover, in the plate-like first yoke 137, an inner V-shaped groove 137*c* is annularly provided so as to connect the positioning projections 137*a*, and an outer V-shaped groove 137*d* surrounds the inner V-shaped groove 137*c*. As shown in FIG. 21A, a rectangular frame-shaped brazing material 173 is positioned, and the opening edge portion on the lower side of the metal cylindrical flange 132 is positioned by the positioning projections 137*a*. The rectangular frame-shaped brazing material 173 is melted to braze the lower opening edge portion of the metal cylindrical flange 132 to the plate-like first yoke 137 (FIG. 21B).

Furthermore, in the plate-like first yoke 137, an upper end portion of the cylindrical fixed iron core 138 is brazed to the fitting hole 137*b* by a brazing material 174.

According to the present invention, the metal cylindrical flange 132 is assembled to the positioning projections 137*a* from above to abut on the same, which enables precise and easy positioning.

Moreover, when the opening edge portion on the lower side of the metal cylindrical flange 132 is integrated with the upper surface of the plate-like first yoke 137 by brazing, even if the melted brazing material flows out, the melted brazing material is retained in the inner V-shaped groove 137*c* and the outer V-shaped groove 137*d*. This prevents the melted brazing material from deeply flowing into the metal cylindrical flange 132, and from flowing outside the plate-like first yoke 137. As a result, since proficiency is not required for the brazing work, and the work is easy, which leads to an advantage of increase in productivity.

Figure 13A:
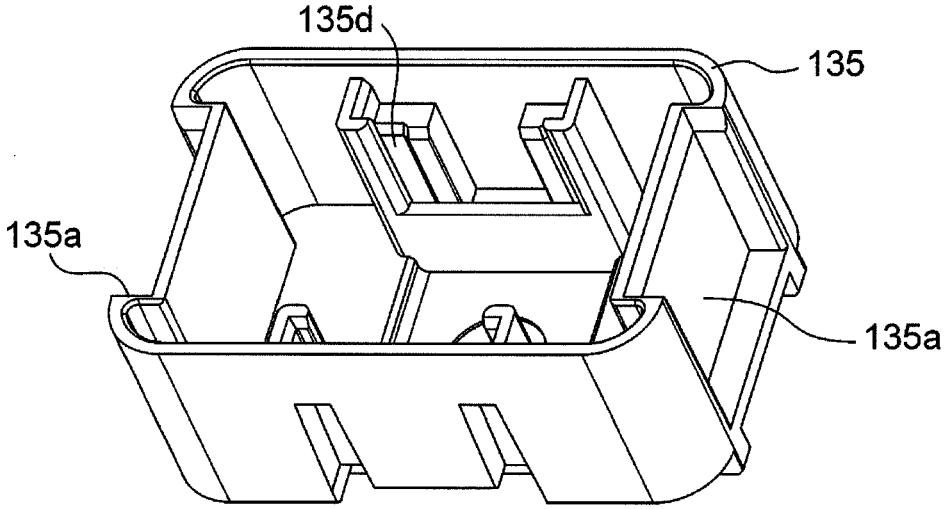
FIGS. 13A and 13B are perspective views when a magnet holder illustrated in FIGS. 7 and 8 is seen from a different angle.
Figure 13B:
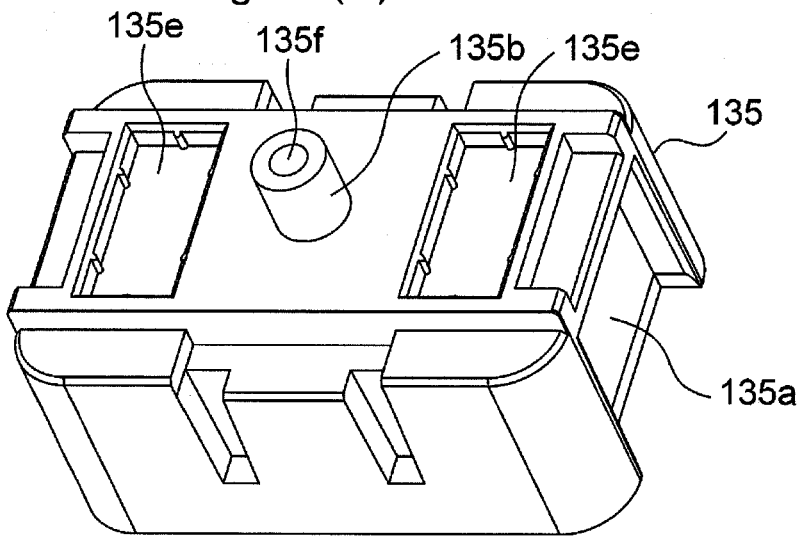
Figure 14:
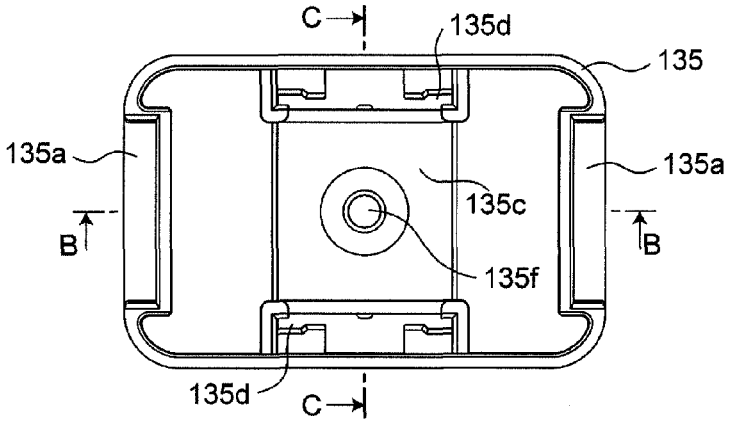
FIG. 14A is a plan view of the magnet holder illustrated in FIGS. 7 and 8, and FIGS. 14B and 14C are cross-sectional views along B-B line and C-C line in FIG. 14A.
Figure 14:
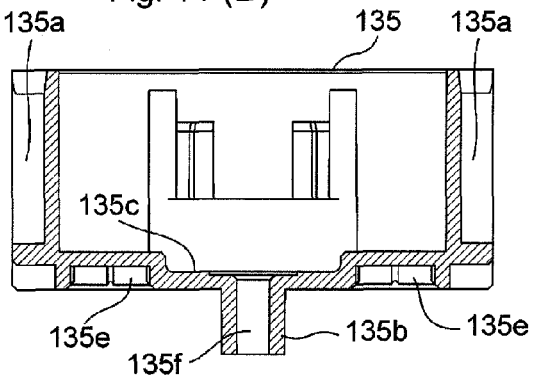
Figure 14:
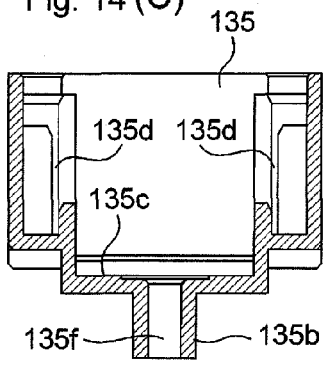

As shown in FIG. 7, the magnet holder 135 has a box shape that can be contained inside the metal cylindrical flange 132, and is formed of a thermally-resistant insulating material. Moreover, as shown in FIGS. 13 and 14, the magnet holder 135 is formed with pocket portions 135*a* capable of holding permanent magnets 136 on opposed both outer side surfaces, respectively. Furthermore, in the magnet holder 135, an annular cradle 135*c* is provided in a bottom-surface center thereof so as to be one-step lower, and a cylindrical insulating portion 135*b* having a through-hole 135*f* is projected downward from a center of the annular cradle 135*c*. In the cylindrical insulating portion 135*b*, even if arc is generated, and a high voltage is caused in a channel of the metal cylindrical flange 132, the plate-like first yoke 137 and the cylindrical fixed iron core 138, insulating the cylindrical fixed iron core 138 and the movable shaft 145 from each other prevents both from melting and adhering to, and being integrated with each other. In the magnet holder 135, depressed portions 135*d* to press position restricting plates 162 described later into are provided in opposed inner surfaces. Furthermore, in the magnet holder 135, a pair of depressions 135*e* in which buffer materials 163 described later can be fitted is provided on a bottom-surface back side thereof.

Figure 15:
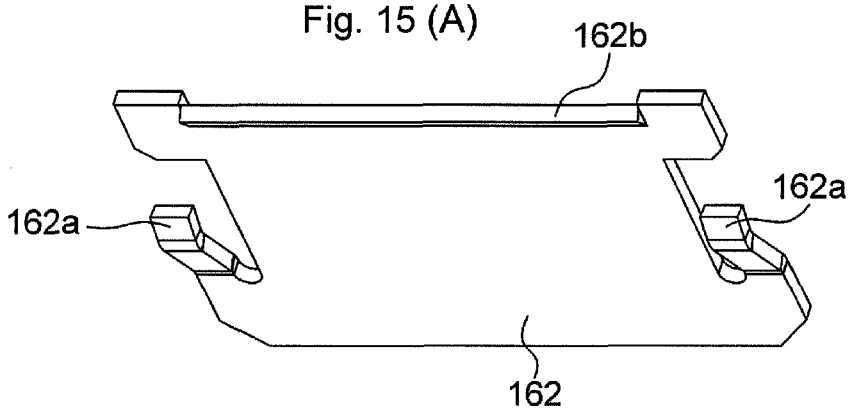
FIGS. 15A, 15B, and 15C are a perspective view, a front view and a cross-sectional view along C-C line in FIG. 15B of a position restricting plate shown in FIGS. 7 and 8.
Figure 15:
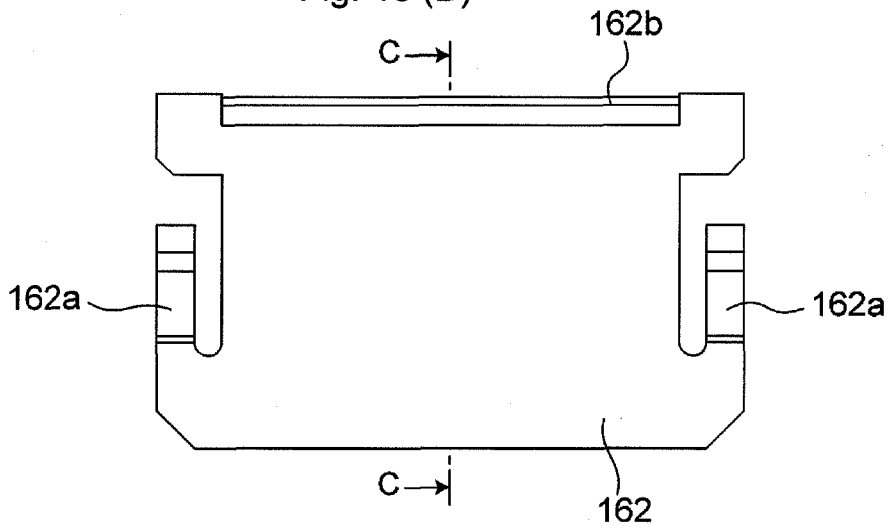
Figure 15:
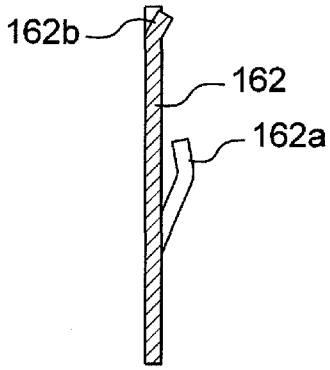

As shown in FIG. 15, the position restricting plates 162 are each made of a substantially rectangular elastic metal plate in a front view, and both side edge portions thereof are cut and raised to form elastic claw portions 162*a*. The position restricting plates 162 are pressed into the depressed portions 135*d* of the magnet holder 135 to restrict idle rotation of the movable contact piece 148 described later.

Figure 16:
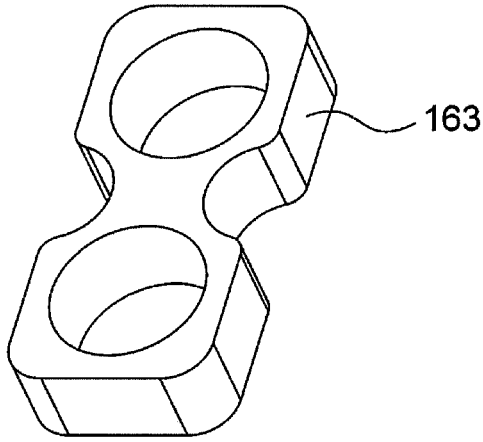
FIGS. 16A, 16B and 16C are a perspective view, a front view and a plan view of a buffer material shown in FIGS. 7 and 8.
Figure 16:
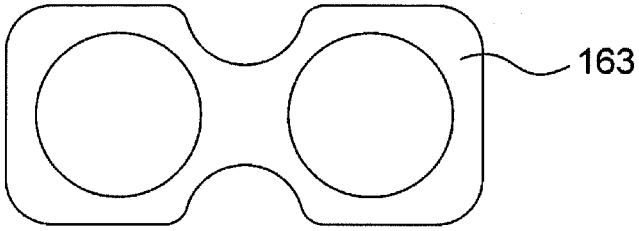
Figure 16:
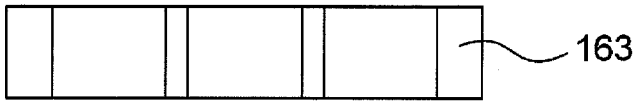

As shown in FIG. 16, the buffer materials 163 are each made of an elastic material, which has a block shape that in a plan view has an appearance which looks substantially like the number 8, and are pressed into the depressions 135*e* of the magnet holder 135 and disposed between the magnet holder 135 and the plate-like first yoke 137 (FIGS. 24A and 25A).

Forming the buffer materials 163 into the substantially 8-shape in a plan view is to obtain desired elasticity in an unbiased manner while assuring a wide floor area and assuring a stable supporting force.

Moreover, according to the present embodiment, not only selection of the materials but also change of the shape enables the elasticity to be adjusted, thereby making silence design easy.

Furthermore, the buffer materials 163 are not limited to the foregoing shape, but for example, a lattice shape or an O shape may be employed.

The buffer materials are not limited to the foregoing block shape, but may have a sheet shape. Moreover, the block-shaped buffer materials and the sheet-like buffer materials may be stacked, and be disposed between the bottom-surface back side of the magnet holder 135 and the plate-like first yoke 137. The buffer materials are not limited to a rubber material or a resin material, but a metal material such as copper alloy, SUS, aluminum and the like may be employed.

As to the cylindrical fixed iron core 138, as shown in FIGS. 7 and 8, the movable shaft 145 with an annular flange portion 145*a* is inserted into a through-hole 138*a* so as to move slidably through the cylindrical insulating portion 135*b* of the magnet holder 135. A return spring 139 is put on the movable shaft 145, and the movable iron core 142 is fixed to a lower end portion of the movable shaft 145 by welding.

As shown in FIG. 39A, the movable iron core 142 has an annular attracting and sticking portion 142*b* in an upper opening edge portion of a cylindrical outer circumferential portion 142*a*, and a cylindrical inner circumferential portion 142*c* is projected inward from an opening edge portion of the annular attracting and sticking portion 142*b*. The cylindrical inner circumferential portion 142*c* is put on, and integrated with the lower end portion of the movable shaft 145.

According to the present embodiment, applying spot facing working to an inside of the movable iron core 142 for weight saving reduces operating sound without decreasing the attraction force.

Moreover, there is an advantage that since the weight of the movable iron core 142 is saved, even if an impact load is applied from outside, an inertia force of the movable iron core 142 is small, which hardly causes malfunction.

As to the bottomed cylindrical body 141 containing the movable iron core 142, an opening edge portion thereof is airtightly bonded to a lower surface edge portion of the caulking hole 137*b* provided in the plate-like first yoke 137. After internal air is suctioned from the vent pipe 134, gas is charged and sealing is performed, by which the sealed space 143 is formed.

Figure 10:
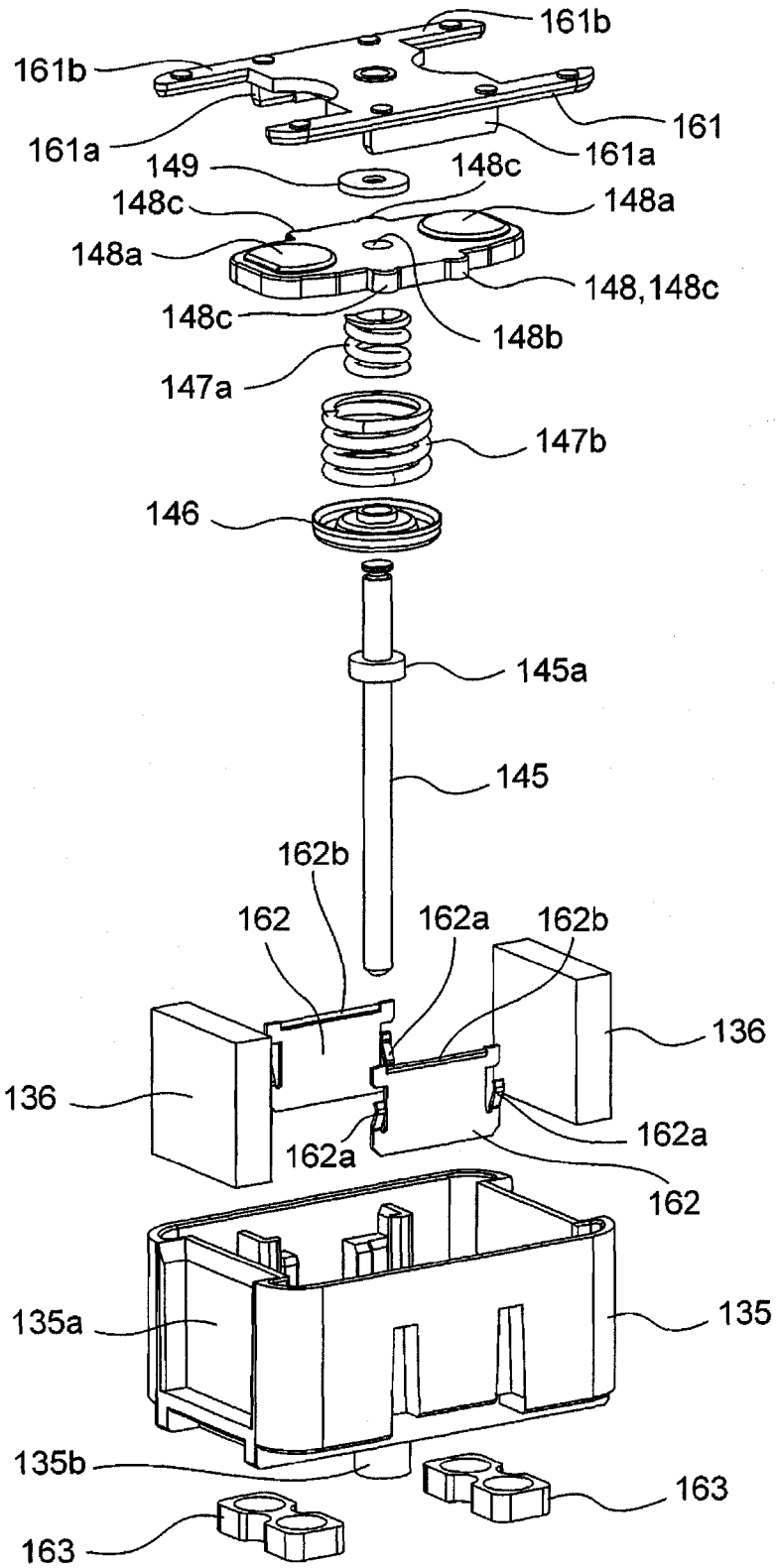
FIG. 10 is a partially enlarged view of the exploded perspective view shown in FIG. 7.
Figure 11:
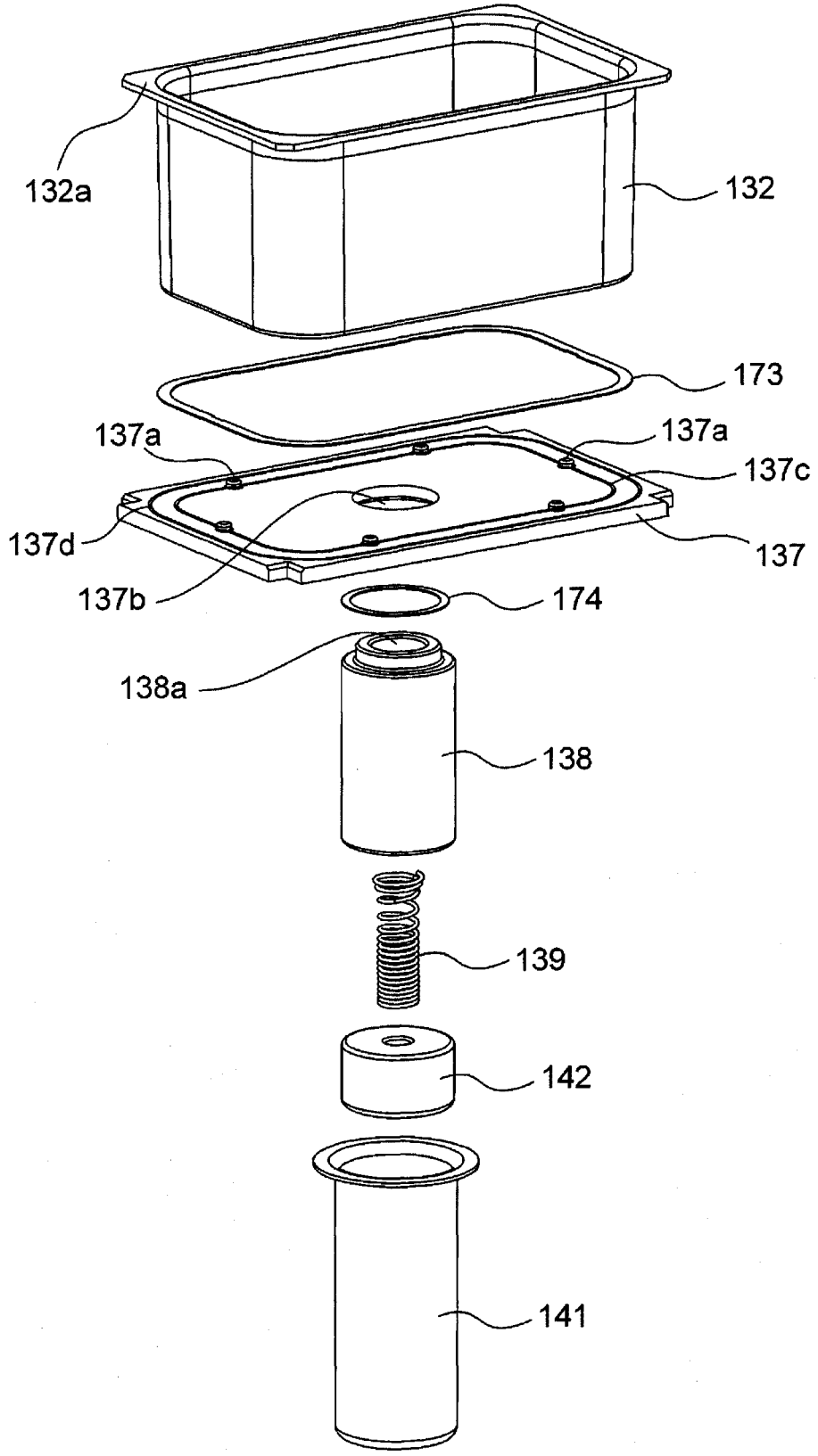
FIG. 11 is a partially enlarged view of the exploded perspective view shown in FIG. 7.

As shown in FIG. 10, the movable shaft 145 is provided with the annular flange portion 145*a* at an intermediate portion thereof.

As illustrated in FIG. 10, movable contacts 148*a* provided in an upper-surface both end portions of the movable contact piece 148 are opposed to the fixed contacts 133*a* of the contact terminals 133 arranged inside the metal cylindrical flange 132 so as to be able to contact and depart from the fixed contacts 133*a*. Moreover, the movable contact piece 148 has, in a center thereof, a shaft hole 148*b* into which the movable shaft 145 can be inserted, and four projections for position restriction 148*c* are provided in an outer circumferential surface thereof.

A disk-like receiver 146 is put on the movable shaft 145, and subsequently, a small contact spring 147*a*, a large contact spring 147*b* and the movable contact piece 148 are put on the movable shaft 145. Furthermore, a retaining ring 149 is fixed to an upper end portion of the movable shaft 145 to thereby retain the movable contact piece 148 and the like.

Figure 22A:
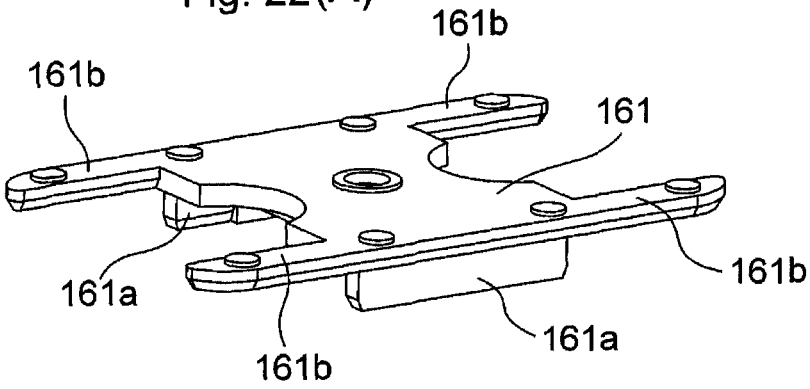
FIGS. 22A, 22B and 22C are a perspective view, a cross-sectional view and a perspective view when seen from a different angle of a lid body shown in FIGS. 7 and 8.
Figure 22:
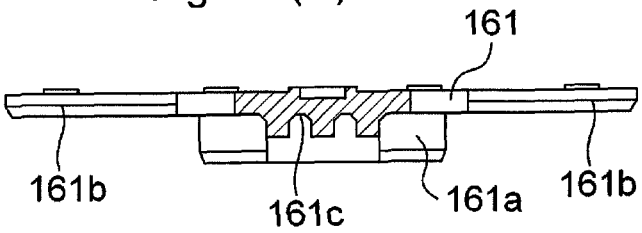
Figure 22C:
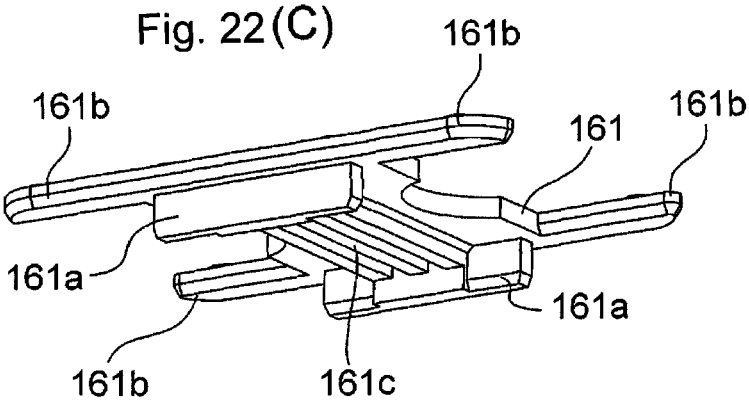

As illustrated in FIG. 10, the lid body 161 has an H shape in a plan view that can be fitted in an opening portion of the magnet holder 135. In the lid body 161, as illustrated in FIG. 22, tongue pieces for position restriction 161*a* are projected in lower-surface both-side edge portions. The lid body 161 restricts floating of the position restricting plates 162 incorporated in the magnet holder 135 by the tongue pieces for position restriction 161*a* thereof. Moreover, four extending portions 161*b* extending laterally from corner portions of the lid body 161 close the opening portion having a complicated shape of the magnet holder 135. The extending portions 161*b*, for example, prevent the metal frame body 160 and the fixed contacts 133*a* from being short-circuited by flow-out from the opening portion of the magnet holder 135 to the outside and deposition of scattered objects caused by arc generated at the time of contact switching. Moreover, a plurality of capture grooves 161*c* are provided side by side so as to bridge between the tongue pieces for position restriction 161*a*, 161*a* on a back surface of the lid body 161. The capture grooves 161*c* efficiently retain the scattered objects generated by the arc, by which the short-circuit between the fixed contacts 133*a*, 133*a* can be prevented, thereby increasing insulation properties.

Figure 27:
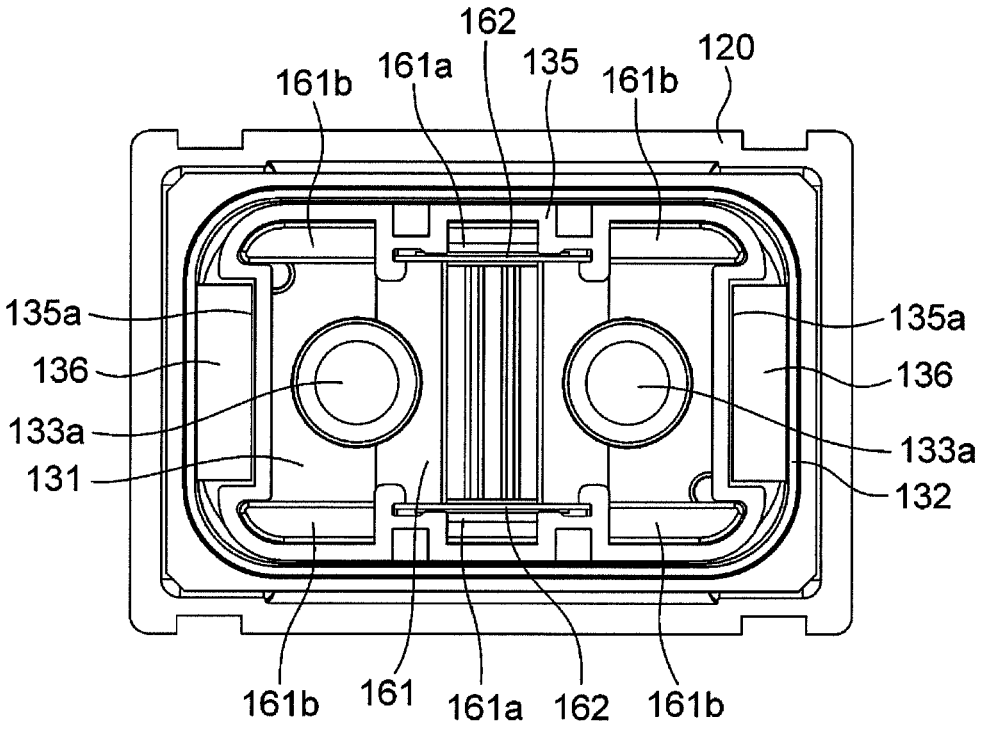
FIG. 27 is a horizontal cross-sectional view of the contact switching device shown in FIG. 6 when seen from underneath.
Figure 29:
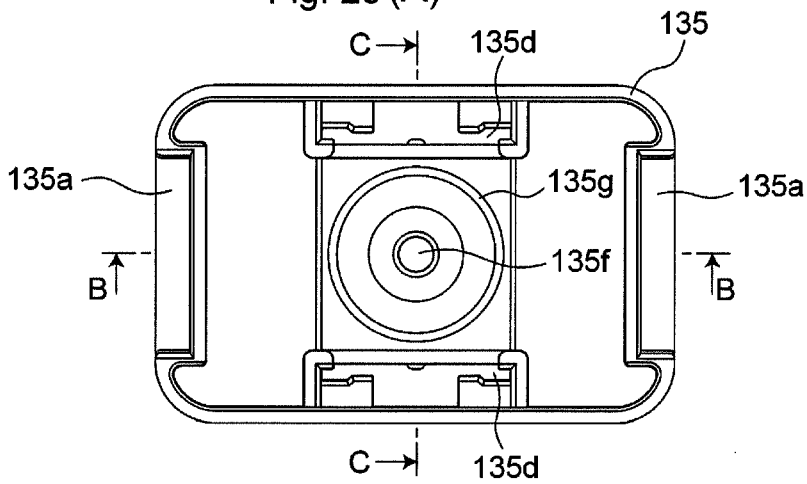
FIG. 29A is a plan view of the magnet holder shown in FIGS. 28, and FIGS. 29B and 29C are cross-sectional views along B-B line and C-C line in FIG. 29A.
Figure 29:
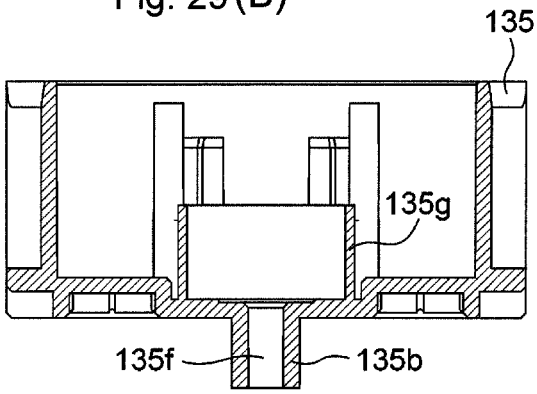
Figure 29:
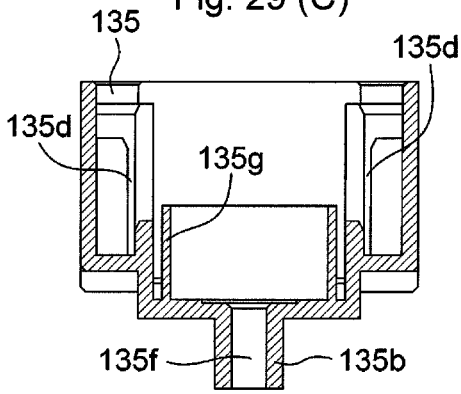
Figure 35A:
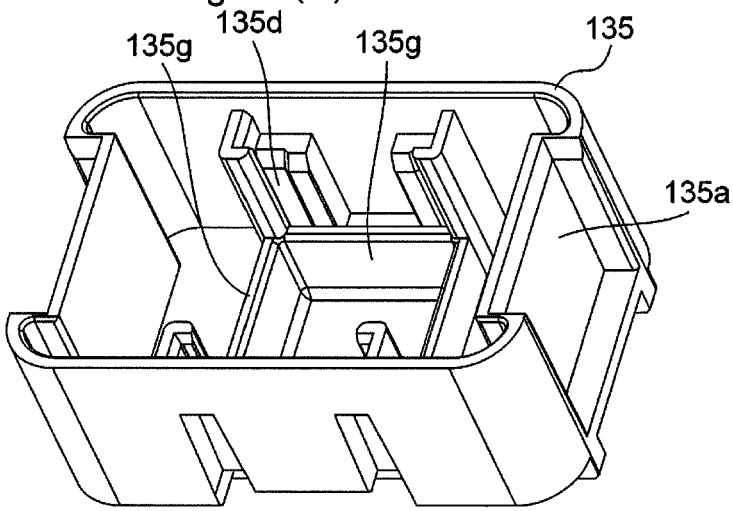
FIG. 35A, FIGS. 35B and 35C are a perspective view, a front cross-sectional view and a side cross-sectional view of FIG. 35A of a magnet holder according to a fifth embodiment of the present invention.
Figure 35B:
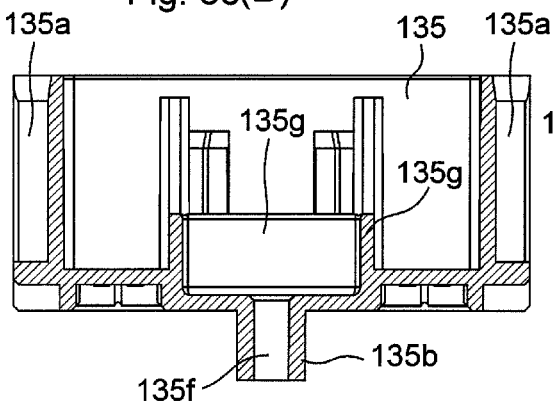
Figure 35C:
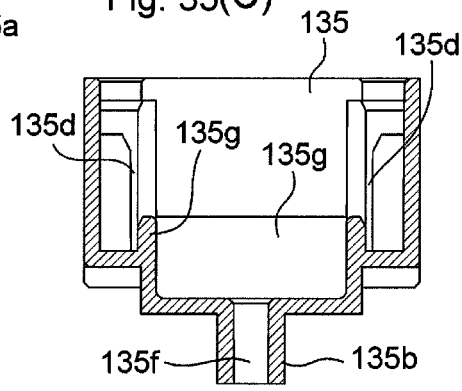

Accordingly, a view when a horizontal cross section of the contact switching device according to the present embodiment to which the position restricting plates 162 are assembled is seen from underneath is as shown in FIG. 27. By magnetic forces of the permanent magnets 136 arranged on both sides of the fixed contacts 133*a*, 133*a*, the generated arc is extended vertically along a paper plane of FIG. 27, based on Fleming's left-hand rule. This allows the scattered objects to be shielded by the extending portions 161*b* of the lid body 161, even if the scattered objects are caused by the arc. As a result, the scattered objects do not flow outside from an interfacial surface between an opening edge portion of the magnet holder 135 and a lower surface of the ceramic plate 131, so that the metal cylindrical flange 132 and the fixed contacts 133*a* are not short-circuited, which brings about an advantage that high insulation properties can be assured.

Figure 23A:
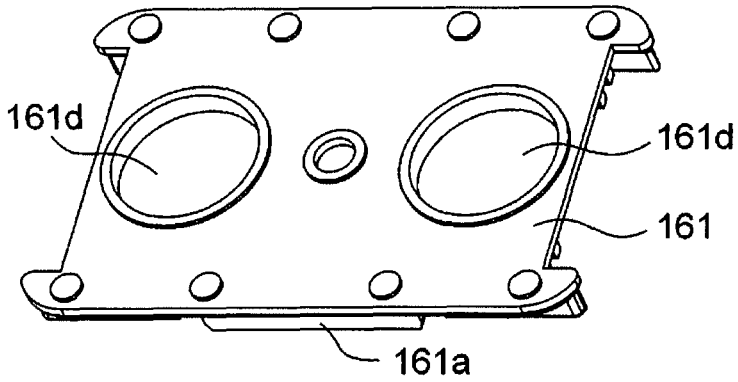
FIGS. 23A, 23B and 23C are a perspective view, a cross-sectional view and a perspective view when seen from a different angle of a modification of the foregoing lid body.
Figure 23B:
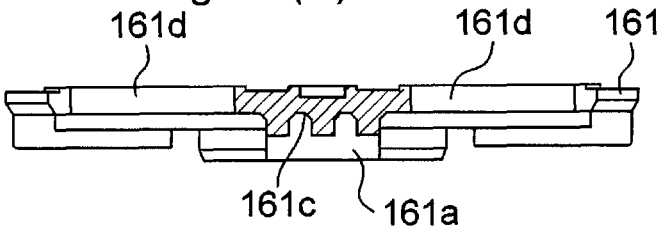
Figure 23C:
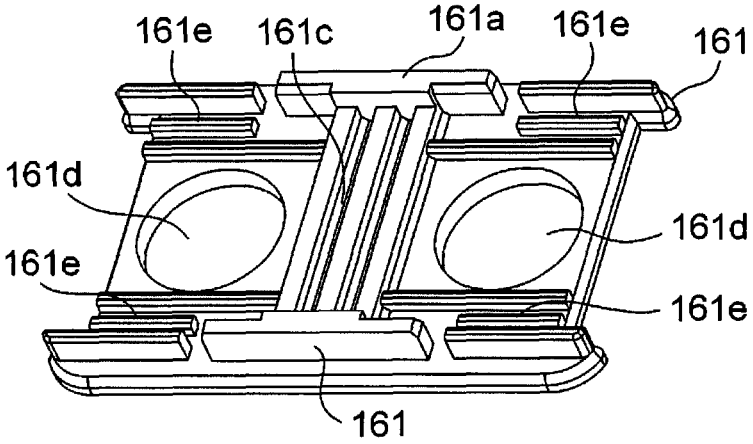

The lid body 161 is not limited to the foregoing shape, but for example, as illustrated in FIG. 23, a rectangular shape that can be fitted in the opening portion of the magnet holder 135 may be employed. In the lid body 161, the tongue pieces for position restriction 161*a*, 161*a* are respectively projected in opposed edge portions on both sides on the back surface, and the plurality of capture grooves 161*c* are provided side by side to efficiently retain the scattered objects between the tongue pieces for position restriction 161*a*, 161*a*. Furthermore, a pair of contact holes 161*d* is provided with the capture grooves 161*c* interposed, and a plurality of capture grooves 161*e* are provided side by side on both sides of the contact holes 161*d*.

Figure 12:
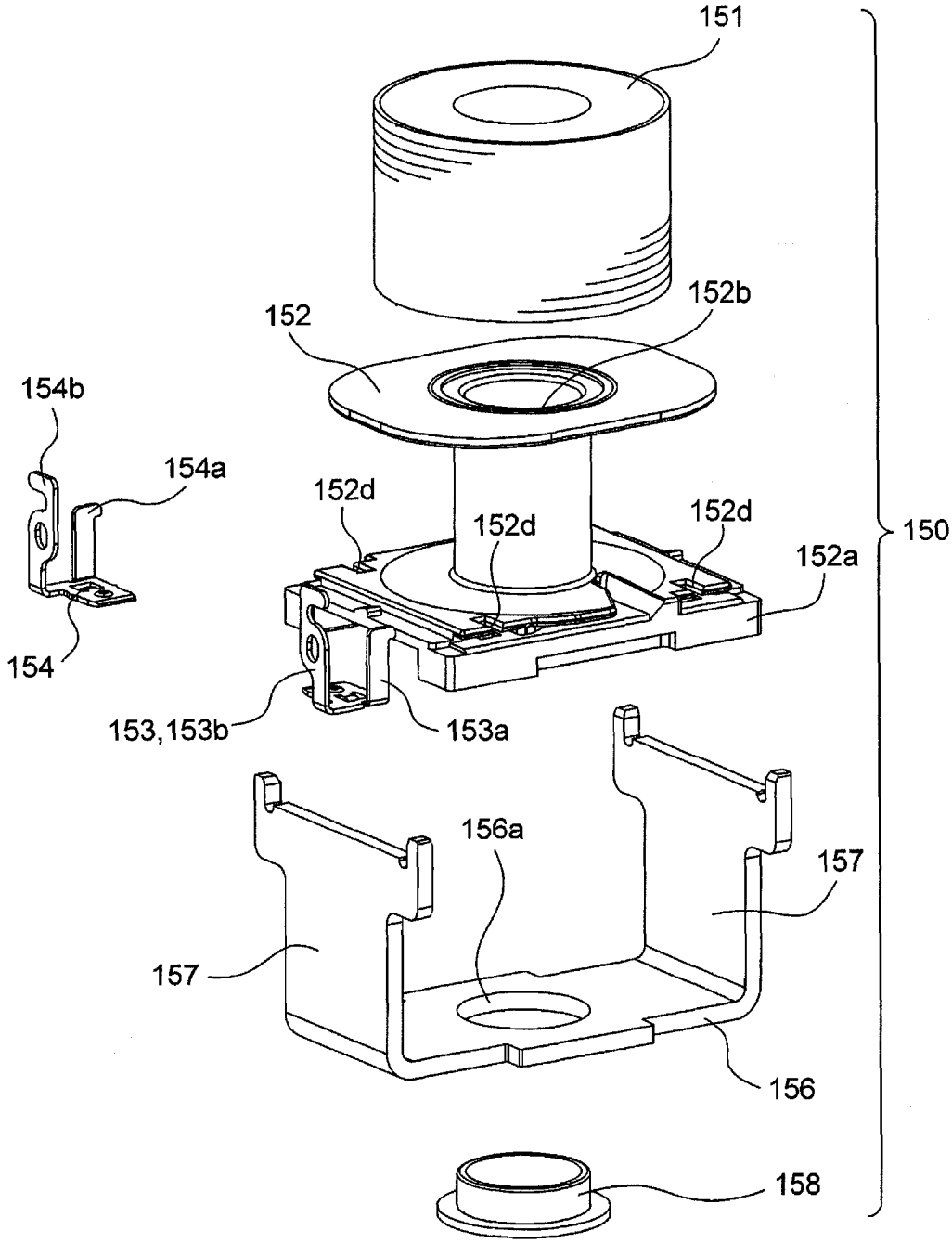
FIG. 12 is a partially enlarged view of the exploded perspective view shown in FIG. 7.

As shown in FIG. 12, in the electromagnet portion 150, coil terminals 153 and 154 are pressed into, and fixed to a flange portion 152*a* of a spool 152 around which a coil 151 is wound. The coil 151 and lead wires not shown are connected through the coil terminals 153 and 154.

Figure 20:
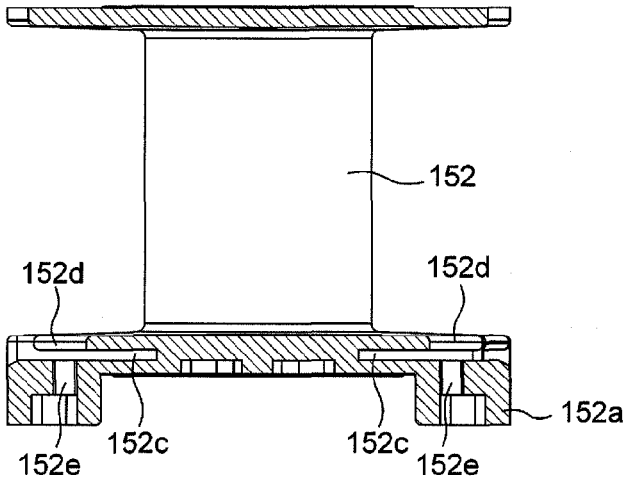
FIG. 20A is a vertical cross-sectional view of a spool.
FIGS. 20B and 20C are perspective views for describing an assembling method of the coil terminals to a flange portion of a spool.
Figure 20:
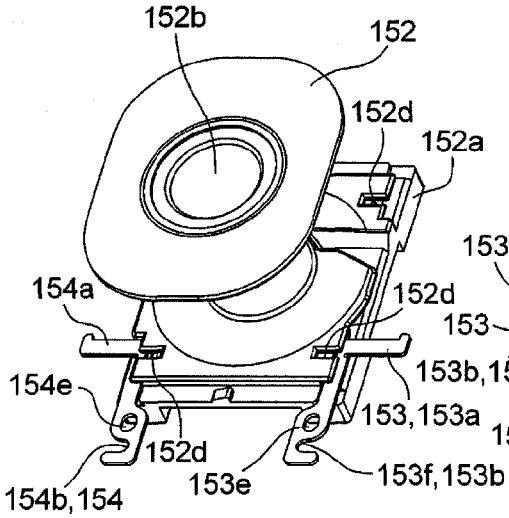
Figure 20:
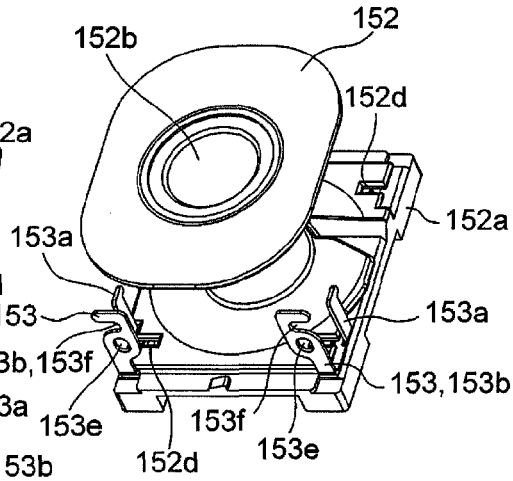

In the present embodiment, as shown in FIG. 20, in the spool 152, slits for press-fitting 152*c* are provided at corner portions of the flange portion 152*a* thereof, and guide grooves 152*d* and locking holes 152*e* are provided so as to communicate with the slits for press-fitting 152*c*.

Figure 18A:
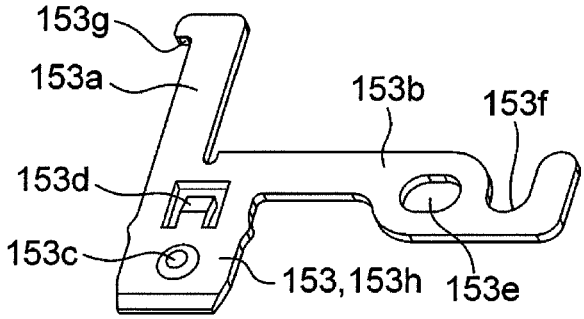
FIGS. 18A, 18B and 18C are a perspective view, a front view and an enlarged cross-sectional view along C-C line in FIG. 18B of a coil terminal shown in FIGS. 7 and 8.
Figure 18:
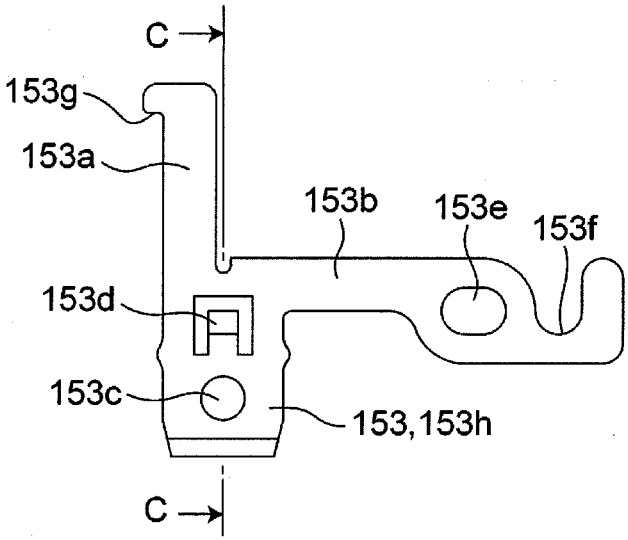
Figure 18:
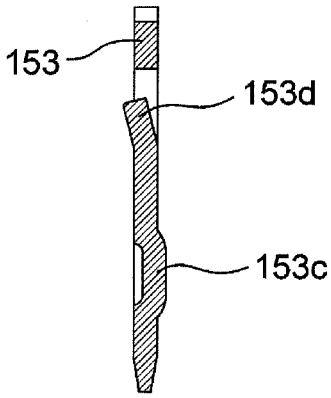
Figure 19:
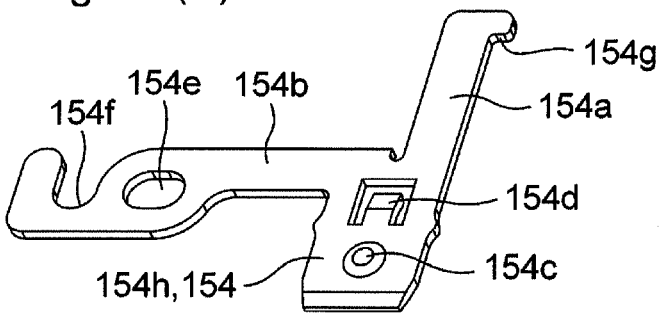
FIGS. 19A, 19B and 19C are a perspective view, a front view and an enlarged cross-sectional view along C-C line in FIG. 19B of another coil terminal.
Figure 19:
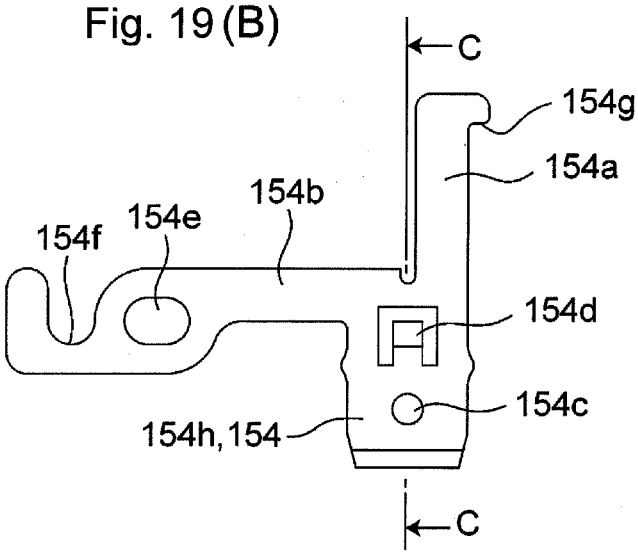
Figure 19:
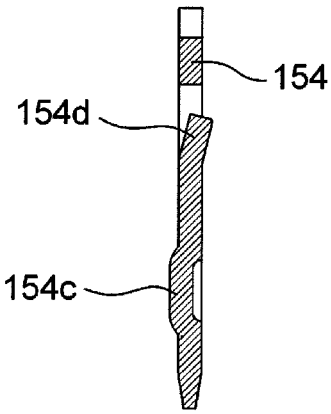

Since the coil terminals 153 and 154 each have a mirror-symmetrical shape as illustrated in FIGS. 18 and 19, only the coil terminal 153 will be described for convenience of description.

As shown in FIG. 18, in the coil terminal 153, a coil entwining portion 153*a* extends in an opposite direction of a press-fitting direction of a press-fitting portion 153*h*, while a lead wire connecting portion 153*b* extends in a direction perpendicular to the press-fitting direction of the press-fitting portion 153*h*. This makes the coil entwining portion 153*a* and the lead wire connecting portion 153*b* orthogonal to each other.

Moreover, in the coil terminal 153, a projection for guide 153*c* is formed in the press-fitting portion 153*h* by a protrusion process, and a locking claw 153*d* is cut and raised.

Furthermore, in the coil entwining portion 153*a*, a cutter surface 15*g* utilizing a warp generated at the time of press working is formed at a free end portion thereof.

In the lead wire connecting portion 153*b*, a hole for inserting the lead wire 153*e* and a cut-out portion for entwining 153*f* are provided adjacently to each other at the free end portion.

In assembling the electromagnet portion 150, the projections for guide 153*c* and 154*c* of the coil terminals 153 and 154 are engaged with the guide grooves 152*d* of the spool 152 illustrated in FIG. 20A, and temporarily joined. The press-fitting portions 153*h* and 154*h* of the coil terminals 153 and 154 are pressed into the slits for press-fitting 152*c*, and the locking claws 153*d* and 154*d* are locked in the locking holes 152*e* and 152*e* to be retained. Subsequently, after winding the coil 151 around the spool 152, lead-out lines of the coil 151 are entwined around the coil entwining portions 153*a*, and 154*a* of the coil terminals 153 and 154, and are cut by the cutter surfaces 153*g* and 154*g* to be soldered. After terminal ends of the lead wires not shown are inserted into the through-holes 153*e* and 154*e* of the coil terminals 153 and 154, they are entwined around the cut-out portions 153*f* and 154*f* and soldered, which allows the coil 151 and the lead wires not shown to be connected.

As shown in FIG. 7, the bottomed cylindrical body 141 is inserted into a through-hole 152*b* of the spool 152, and is inserted into a fitting hole 156*a* of a second yoke 156 to be fitted on a fixed flange 158. Subsequently, upper-end corner portions of both side portions 157, 157 of the second yoke 156 are engaged with corner portions of the plate-like first yoke 137 to be fixed by means of caulking, press-fitting, welding or the like, by which the electromagnet portion 150 and the contact mechanical portion 130 are integrated. As a result, the substantially 8-shaped buffer materials 163 fitted in the depressions 135*e* of the magnetic holder 135 are disposed between the plate-like first yoke 137 and the magnet holder 135 (FIGS. 24A and 25A).

According to the present embodiment, since in the coil terminal 153, the coil entwining portion 153*a* and the lead wire connecting portion 153*b* are provided separately, the coil 151 does not disturb the connection work of the lead wire, which increases workability.

Moreover, the use of the through-hole 153*e* and the cut-out portion 153*f* provided in the lead wire connecting portion 153*b* makes the connection easier, and makes coming-off of the lead wire more difficult.

Furthermore, when the coil entwining portion 153*a* and the lead wire connecting portion 153*b* are bent and raised at a right angle, both stand at adjacent corner portions of the flange portion 152*a*, respectively. Thus, there is an advantage that an insulation distance from the wound coil 151 to the lead wire becomes longer, so that the electromagnet portion 150 high in insulation properties can be obtained.

Obviously, the coil terminal 154 having the mirror-symmetrical shape to the coil terminal 153 has an advantage similar to that of the coil terminal 153.

While in the foregoing embodiment, a case where the coil 151 is wound around the spool 152 one time has been described, when the coil 151 is wound doubly, the three coil terminals may be arranged at the three corner portions of the flange portion 152*a* of the spool 152 as needed.

Next, operation of the sealed electromagnetic relay constituted as described above will be described.

Figure 24:
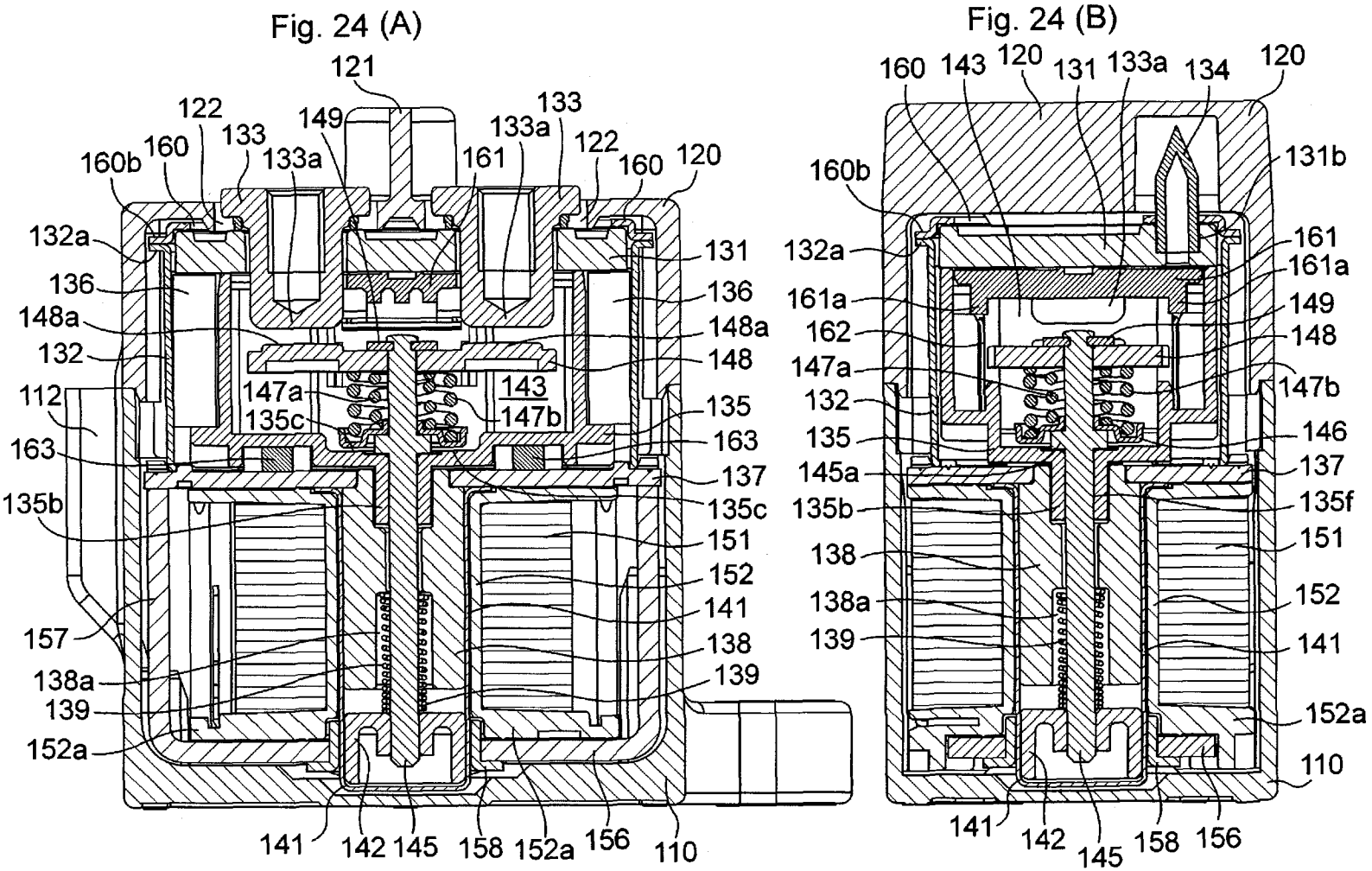
FIGS. 24A and 24B are a front cross-sectional view and a side cross-sectional view before operation of the contact switching device according to the second embodiment shown in FIGS. 6.

First, as shown in FIG. 24, when a voltage is not applied to the coil 151, the movable iron core 142 is biased downward by a spring force of the return spring 139, so that the movable shaft 145 is pushed downward, and the movable contact piece 148 is pulled downward. At this time, although the annular flange portion 145*a* of the movable shaft 145 is engaged with the annular cradle 135*c* of the magnet holder 135 and the movable contacts 148*a* depart from the fixed contacts 133*a*, the movable iron core 142 does not abut on the bottom surface of the bottomed cylindrical body 141.

Figure 25:
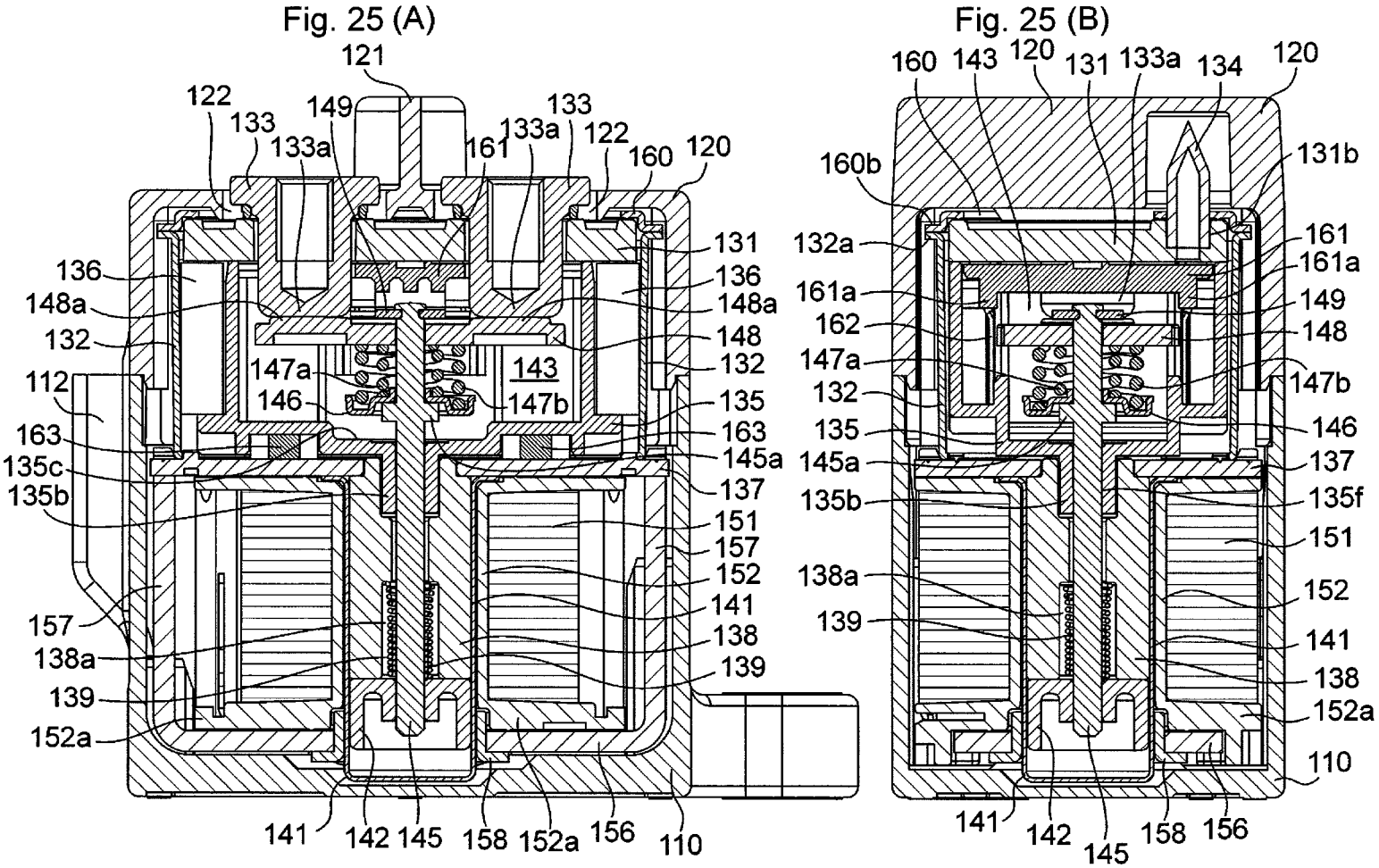
FIGS. 25A and 25B are a front cross-sectional view and a side cross-sectional view after operation of the contact switching device according to the second embodiment shown in FIGS. 6.

Subsequently, when the voltage is applied to the coil 151 to excite the same, as illustrated in FIG. 25, the movable iron core 142 is attracted by the fixed iron core 138, so that the movable shaft 145 slides and moves upward against the spring force of the return spring 139. Even after the movable contacts 148*a* come into contact with the fixed contacts 133*a*, the movable shaft 145 is pushed up against spring forces of the return spring 139, the small contact spring 147*a*, and the large contact spring 147*b*. This allows the upper end portion of the movable shaft 145 to be projected from the shaft hole 148*b* of the movable contact piece 148, so that the movable iron core 142 is attracted and stuck to the fixed iron core 138.

In the present embodiment, there is an advantage that since the small contact spring 147*a* and the large contact spring 147*b* are used in combination, spring loads can be easily in line with the attraction force of the electromagnet portion 150, which makes adjustment of the spring forces easy.

When the application of the voltage to the coil 151 is stopped to release the excitation, the movable iron core 142 departs from the fixed iron core 138, based on the spring forces of the small contact spring 147*a*, the large contact spring 147*b* and the return spring 139. This allows the movable shaft 145 to slide and move downward, so that the movable contacts 148*a* depart from the fixed contacts 133*a*, and then, the annular flange portion 145*a* of the movable shaft 145 is engaged with the annular cradle 135*c* of the magnet holder 135, thereby returning to an original state (FIG. 24).

According to the present embodiment, an impact force of the movable shaft 145 is absorbed and alleviated by the buffer materials 163 through the magnet holder 135. Particularly, even when the movable shaft 145 returns to the original state, the movable iron core 142 does not abut on the bottom surface of the bottomed cylindrical body 141. Therefore, the present embodiment has an advantage that hitting sound of the movable shaft 45 is absorbed and alleviated by the magnet holder 135, the buffer materials 163, the fixed iron core 138, the electromagnet portion 150 and the like, thereby bringing about the sealed electromagnetic relay having small switching sound.

Moreover, according to the position restricting plates 162 of the present embodiment, as illustrated in FIG. 26, vertical movement of the movable shaft 145 allows the movable contact piece 148 to vertically move. At this time, even if shaking occurs in the movable contact piece 148, the projections for position restriction 148*c* of the movable contact piece 148 abut on the position restricting plates 162 pressed into the depressed portions 135*d* of the magnet holder 135, so that the position of the movable contact piece 148 is restricted. Thus, the movable contact piece 148 does not directly come into contact with the magnet holder 135 made of resin, which prevents resin powder from being produced, so that a contact failure does not occur. Particularly, since the position restricting plates 162 are formed of the same metal material as the movable contact piece 148, abrasion powder is hardly produced.

As in a conventional example, if the attraction force is addressed by one contact spring while assuring predetermined contact follow, it is hard to obtain a desired contact force as shown in FIG. 37B. Therefore, if a spring constant is increased to obtain a desired spring load while maintaining the contact follow, the spring load may become larger than the attraction force, which deteriorates operation characteristics (FIG. 37C). On the other hand, if the desired contact force is obtained while maintaining desired operation characteristics, the contact follow becomes small, which causes trouble that a contact failure easily occurs when the contact is abraded, thereby shortening life duration (FIG. 37D).

In contrast, according to the present embodiment, as illustrated in FIG. 37A, since the spring load can be adjusted in two steps, the spring load can be adjusted so as to be in line with the attraction force of the electromagnet portion 150. Thus, the larger contact force and the larger contact follow can be assured, and the contact switching device favorable in operation characteristics can be obtained.

Particularly, according to the present embodiment, the small contact spring 147*a* is arranged inside the large contact spring 147*b*. Therefore, at the operating time, the large contact spring 147*b* having a large length dimension and a small spring contact is first pressed (between P1 and P2 in the contact follow in FIG. 37A). Thereafter, the small contact spring 147*a* having a small length dimension and a large spring constant is pressed (on the left side of P2 in the contact follow in FIG. 37A). As a result, it becomes easy for the spring load to be in line with the attraction force of the electromagnet portion, which rapidly increases at an end stage of the operation, so that the desired contact force can be obtained and the contact switching device having a small height dimension can be obtained.

Since as the large contact spring 147*b* and the small contact spring 147*a*, coil springs are used, they do not spread radially, and a radial dimension can be made small.

Furthermore, there is an advantage that since the small contact spring 147*a* is put on the movable shaft 145, backlash hardly occurs, so that the electromagnetic relay without fluctuations in operation characteristics can be obtained.

The arrangement may be such that the length dimension of the small contact spring 147*a* is larger than that of the large contact spring 147*b*, the spring constant is smaller than that of the large contact spring 147*b*, so that the small contact spring 147*a* is first pressed. Moreover, the constitution may be such that the small contact spring 147*a* and the large contact spring 147*b* are joined at one-end portions to continue to each other. In these cases, the desired contact force can be obtained.

As illustrated in FIGS. 28 to 31, in a third embodiment according to the present invention, an annular partition wall 135*g* is provided so as to surround the through-hole 135*f* provided in a bottom-surface center of the magnet holder 135.

According to the present embodiment, as shown in FIG. 30, an opening edge portion of the annular partition wall 135*g* approaches a lower surface vicinity of the movable contact piece 148. Therefore, there is an advantage that the scattered objected generated by the arc or the like hardly enter the through-hole 135*f* of the magnet holder 135, thus hardly causing an operation failure.

Since other constitutions are similar to those of the foregoing embodiments, the same portions are given the same numbers, and descriptions thereof are omitted.

In a fourth embodiment, as shown in FIGS. 32 to 34, an annular partition wall 148*d* is projected in a lower surface center of the movable contact piece 148. Therefore, the annular partition wall 148*d* of the movable contact piece 148 is fitted on the annular partition wall 135*g* provided in the magnet holder 135 from outside, which can make a creepage distance of both longer.

According to the present embodiment, there is an advantage that the creepage distance from an outer circumferential edge portion of the movable contact piece 148 to the through-hole 135*f* of the magnet holder 135 becomes still longer, which makes it hard for dust and the like to enter the through-hole 135*f*, thereby increasing durability.

While in the foregoing embodiment, the case where the annular partition wall 135*g* is provided in the bottom-surface center of the magnet holder 135 has been described, the invention is not limited thereto. For example, as in a fifth embodiment illustrated in FIG. 35, a pair of partition walls may extend parallel so as to bridge opposed inner side surfaces of the magnet holder 135, and the through-hole 135*f* may be finally partitioned by the rectangular frame-shaped partition wall 135*g*.

Figure 36A:
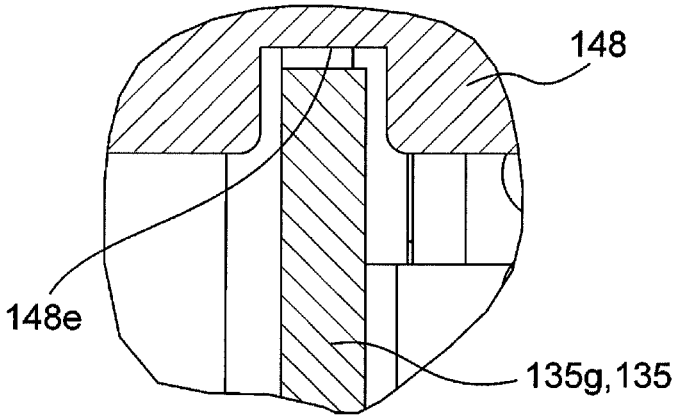
FIGS. 36A and 36B are partially enlarged cross-sectional views of magnet holders according to sixth and seventh embodiments of the present invention.

Moreover, as in a sixth embodiment illustrated in FIG. 36A, an upper end edge portion of the annular partition wall 135*g* projected in the bottom-surface center of the magnet holder 135 may be fitted in an annular groove 148*e* provided in a lower surface of the movable contact piece 148 to prevent dust from coming in.

Figure 36B:
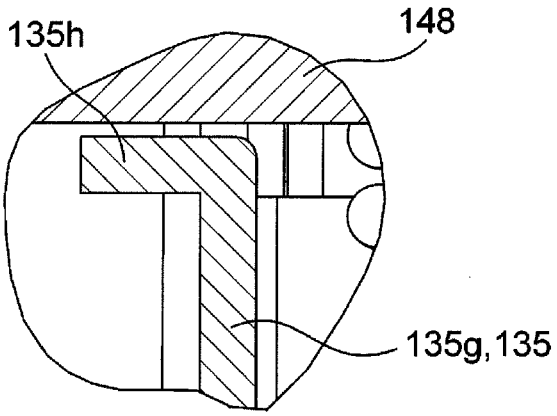

Furthermore, as in a seventh embodiment illustrated in FIG. 36B, an annular flange portion 135*h* may be extended outward from the upper end edge portion of the annular partition wall 135*g* provided in the magnet holder 135. The lower surface of the movable contact piece 148 and the annular flange portion 135*h* are vertically opposed to each other with a gap formed, which prevents the scattered objects from coming in.

EXAMPLES

Example 1

In the contact switching device of the second embodiment, using a case where only the 8-shaped buffer materials 163 made of CR rubber were incorporated as a sample of Example 1, and a case where the buffer materials 163 were not incorporated as a sample of Comparative Example 1, return sound of both was measured.

As a result of measurement, in the example and the comparative examples, a decrease by 5.6 dB could be confirmed in the return sound.

Example 2

In the contact switching device of the second embodiment, using a case where only the sheet-like buffer materials were incorporated as a sample of Example 2, and a case where the sheet-like buffer materials were not incorporated as a sample of Comparative Example 2, the return sound of both was measured.

As a result of measurement, as compared with the return sound of Comparative Example 2, a decrease in the return sound by 11.6 dB could be confirmed in the sheet-like buffer materials made of copper having a thickness of 0.3 mm according to Example 2, a decrease in the return sound by 10.6 dB could be confirmed in the sheet-like buffer materials made of SUS having a thickness of 0.3 mm, and a decrease in the return sound by 8.6 dB could be confirmed in the sheet-like buffer materials made of aluminum having a thickness of 0.3 mm, so that silencing was found to be enabled.

Example 3

In the contact switching device of the second embodiment, using a case where the substantially 8-shaped buffer materials made of CR rubber and the sheet-like buffer materials were combined as a sample of Example 3, and a case where none of the buffer materials was assembled as a sample of Comparative Example 3, the return sound of both was measured.

As a result of measurement, as compared with the return sound of Comparative Example, a decrease in the return sound by 15.9 dB could be confirmed in the combination of the 8-shaped buffer materials and the sheet-like buffer materials made of copper having a thickness of 0.3 mm according to Example 3, a decrease in the return sound by 18 dB could be confirmed in the 8-shaped buffer materials and the sheet-like buffer materials made of SUS having a thickness of 0.3 mm, and a decrease in the return sound by 20.1 dB could be confirmed in the 8-shaped buffer materials and the sheet-like buffer materials made of aluminum having a thickness of 0.3 mm, so that further silencing was found to be enabled.

Example 4

As shown in FIG. 38, by applying spot facing working to the movable iron core 142, relationships between the weight saving and the silencing were measured.

That is, as shown in FIGS. 38A, 38B, and 38C, the spot facing working was applied to the movable iron core 142 to save the weight, and the operating sound was measured.

As a result, as shown in FIGS. 38D and 38E, it could be confirmed that as the spot facing was deeper, the weight of the movable iron core was saved more, so that the operating sound was reduced.

Example 5

Variation in the attraction force when the outer circumferential portion 142*a* of the movable iron core 142 having an outer diameter $\phi 1$ shown in FIG. 39A was made thinner was measured. As shown in FIG. 39B, it was found that if a ratio between the outer diameter and an inner diameter was 77% or less, the attraction force characteristics were not affected.

Moreover, for a movable iron core having an outer diameter $\phi 1'$ ($=\phi 1 \times 1.75$) which was larger than that of the foregoing movable iron core, the attraction force characteristics were measured similarly. As shown in FIG. 39C, it was found that if the ratio between the outer diameter and the inner diameter was 74% or less, the attraction force characteristics were not affected.

From measurement results described above, it was found that if the ratio between the outer diameter and the inner diameter was 77% or less, preferably 74% or less, the attraction force characteristics to the movable iron core were not affected.

Example 6

Moreover, the attraction force characteristics when the attracting and sticking portion 142*b* of the movable iron core 142 having the large outer diameter $\phi 1'$ ($=\phi 1 \times 1.75$) was made thinner were measured.

As shown in FIG. 39D, it was confirmed that if a height dimension of the attracting and sticking portion 142*b* of the movable iron core 142 was ⅕ or more of a height dimension t3 of the outer circumferential portion 142*a*, the attraction force was not affected.

From the above-described measurement result, it was found that the lighter the movable iron core was, the more the operating sound could be reduced. Particularly, it was found that silencing could be performed while avoiding reducing the attraction force by making smaller a thickness dimension of the attracting and sticking portion by the spot facing working for the weight saving more effectively than by making thinner the thickness of the outer circumferential portion of the movable iron core.

The inner circumferential portion 142*c* of the movable iron core 142 is to surely support the lower end portion of the movable shaft 145, but is not necessarily required and only needs to have a minimum necessary size.

INDUSTRIAL APPLICABILITY

Obviously, the application of the coil terminal according to the present invention is not limited to the foregoing electromagnetic relay, but the coil terminal can be applied to another electric instrument.

There has thus been shown and described a novel coil terminal using the same which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

We claim:

1. A coil terminal pressed into a press-fitting groove provided at a corner portion of a flange portion of a spool with a coil wound therearound, the coil terminal comprising:

a press fitting portion, a coil entwining portion, a lead wire entwining portion;

wherein the coil entwining portion and the lead wire entwining portion extend in a direction perpendicular to said press fitting portion;

wherein a plane formed by the coil entwining portion is perpendicular to a plane formed by the lead wire entwining portion and said coil entwining portion, and said lead wire entwining portion are disposed adjacent to each other at said corner portion.

2. The coil terminal according to claim 1, wherein the lead wire entwining portion extends in a direction orthogonal to the press-fitting direction of the press-fitting portion so as to be able to be bent and raised.

3. The coil terminal according to claim 2, wherein a retaining projection is cut and raised in the press-fitting portion.

4. The coil terminal according to claim 2, wherein a hole for lead wire insertion and a cut-out portion for entwining are provided adjacently at a free end portion of the lead wire entwining portion.

5. The coil terminal according to claim 2, wherein a cutter surface for cutting a lead-out line of the coil is formed at a free end portion of the coil entwining portion.

6. The coil terminal according to claim 1, wherein a retaining projection is cut and raised in the press-fitting portion.

7. The coil terminal according to claim 6, wherein a hole for lead wire insertion and a cut-out portion for entwining are provided adjacently at a free end portion of the lead wire entwining portion.

8. The coil terminal according to claim 6, wherein a cutter surface for cutting a lead-out line of the coil is formed at a free end portion of the coil entwining portion.

9. The coil terminal according to claim 1, wherein a hole for lead wire insertion and a cut-out portion for entwining are provided adjacently at a free end portion of the lead wire entwining portion.

10. The coil terminal according to claim 9, wherein a cutter surface for cutting a lead-out line of the coil is formed at a free end portion of the coil entwining portion.

11. The coil terminal according to claim 1, wherein a cutter surface for cutting a lead-out line of the coil is formed at a free end portion of the coil entwining portion.

* * * * *